US006222171B1

(12) United States Patent
Fukuda et al.

(10) Patent No.: US 6,222,171 B1
(45) Date of Patent: Apr. 24, 2001

(54) COOKING APPLIANCE THAT CAN BE EASILY INSTALLED BY SMALL MAN LABOR

(75) Inventors: Yoshito Fukuda, Kouka-gun; Junji Murata, Kusatsu; Takashi Fukuda, Ibaraki; Masaru Nishimura; Kenji Kume, both of Otsu; Miho Fujii, Kurita-gun, all of (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/414,833

(22) Filed: Oct. 8, 1999

(30) Foreign Application Priority Data

Oct. 8, 1998 (JP) ..... 10-286608
Oct. 16, 1998 (JP) ..... 10-295311
Jan. 27, 1999 (JP) ..... 11-018842

(51) Int. Cl.[7] ..... H05B 6/68
(52) U.S. Cl. ..... 219/757; 219/702; 248/274; 248/309.1
(58) Field of Search ..... 219/757, 702, 219/716, 718, 710; 126/273 A; 248/674, 309.1

(56) References Cited

U.S. PATENT DOCUMENTS 4,254,450 * 3/1981 White et al. ..... 362/92
4,313,043 * 1/1982 White et al. ..... 219/702
4,327,274 * 4/1982 White et al. ..... 217/702
4,453,690 * 6/1984 Takeuji ..... 248/309.1
4,659,047 * 4/1987 Haller ..... 248/274.1
4,720,622 * 1/1988 Iwata et al. ..... 219/391
4,796,850 * 1/1989 Aramaki ..... 248/674
5,209,445 * 5/1993 Bergetz ..... 248/551
5,986,245 * 11/1999 Kang ..... 219/702
6,072,169 * 6/2000 Kang et al. ..... 219/702
6,104,016 * 8/2000 Lee ..... 219/702

* cited by examiner

*Primary Examiner*—Teresa Walberg
*Assistant Examiner*—Jeffrey Pwu
(74) *Attorney, Agent, or Firm*—Armstrong, Westerman, Hattori, McLeland & Naughton, LLP

(57) ABSTRACT

A microwave oven includes electronic components such as a high voltage transformer and a high voltage capacitor constituting a control circuit. These components are provided on a bottom panel of the microwave oven. A filter is fit under the bottom panel of the microwave oven. By removing the filter, the bottom panel can be detached from the main body frame. By detaching the bottom panel from the main body frame, the electronic components such as the high voltage transformer and the high voltage capacitor can be removed from the main body of the microwave oven while the microwave oven is still mounted at a high position. A cooking appliance that can be easily handled is provided.

11 Claims, 30 Drawing Sheets

COOKING APPLIANCE THAT CAN BE EASILY INSTALLED BY SMALL MAN LABOR

BACKGROUND OF THE INVENTION

1. Field of the Invention

The present invention relates to a cooking appliance, and a method of installing this cooking appliance. More particularly, the present invention relates to a high-placement type cooking appliance such as a microwave oven attached at a high position to a wall or within a cabinet in a kitchen, and a method of installing this cooking appliance.

2. Description of the Background Art

Installing the cooking appliance at a wall or within a cabinet in a kitchen is advantageous from the standpoint of effectively using limited space. Such a cooking appliance attached at a high position to a wall or installed within a cabinet is referred to as a high-placement type cooking appliance hereinafter.

This high-placement type cooking appliance is disadvantageous in that the installment job is difficult.

In the case of installing a cooking appliance to the wall, for example, great man labor is required since the installation includes the supporting job and the attaching job, as shown in FIGS. 36A and 36B. More specifically, two workmen are required to engage the fastening member of a cooking appliance 100 with a predetermined portion of a wall 110 while supporting cooking appliance 100, as shown in FIG. 36A. Referring to FIG. 36B, the two workmen attach cooking appliance 100 to wall 110 while supporting cooking appliance 100. It is appreciated from these drawings that at least two workmen are required in the conventional installment of a cooking appliance corresponding to the supporting job and the attaching job. A great man labor was required in the conventional installment of a cooking appliance. It was not easy to handle a cooking appliance.

The conventional high-placement type cooking appliance is also disadvantageous in that the repair of the internal components constituting the control means requires great man power. When an internal component is to be removed for repair, the cooking appliance attached to the wall had to be dismounted to remove the internal component. Alternatively, the front panel of the cooking appliance attached to the wall had to be removed. Then, the internal component secured at a predetermined location inside the cooking appliance had to be removed through the opening. In other words, the conventional cooking appliance required the step of dismounting the cooking appliance per se or a predetermined panel, and also the step of removing the internal component from a predetermined location in the cooking appliance. The internal component could be repaired only through the load of great man labor. The conventional cooking appliance could not be handled easily.

The interior of the conventional cooking appliance becomes higher in temperature than the room temperature since a cooking operation such as heating foodstuff is carried out. The conventional cooking appliance includes an inlet and an outlet to introduce the air into the cooking appliance for cooling the interior and to exhaust the air in the cooking appliance outside.

In the conventional cooking appliance, the inlet and the outlet are open even when the air is not introduced or output. There was a problem that dust and contamination will be introduced into the cooking appliance through the inlet or the outlet even when the operation of air input and output is not carried out in the conventional cooking appliance.

SUMMARY OF THE INVENTION

In view of the foregoing, an object of the present invention is to provide a cooking appliance that can be handled easily.

Another object of the present invention is to provide a method of easily installing a cooking appliance.

A further object of the present invention is to provide a cooking appliance into which dust and contamination do not easily enter.

According to an aspect of the present invention, a cooking appliance includes a heat unit for heating foodstuff, a controller for controlling the operation of the heat unit, and a casing enclosing the heat unit and the controller. The cooking appliance is attached to a fixture panel fixed to a sidewall. The casing includes a bottom panel located at the bottom of the casing, and a body frame covering the upper portion of the bottom panel. The controller is provided on the bottom panel. The bottom panel is detachable from the body frame with the cooking appliance still attached to the fixture panel.

It is to be noted that the bottom panel can be detached from the body frame while the cooking appliance is still attached to the fixture panel. In other words, the controller can be detached from the body frame with the cooking appliance still attached to the fixture panel.

Since the controller can be easily removed from the cooking appliance, the internal components constituting the controller can be repaired, if necessary, more easily. Thus, a cooking appliance feasible in handling can be provided.

According to another aspect of the present invention, a method of installing a cooking appliance having a fastening member engaging with a fixture panel fixed to a sidewall includes the steps of setting the cooking appliance at a first state in which the cooking appliance is tilted forward in front of the sidewall on a predetermined base, setting the cooking appliance at a second state from the first state in which the cooling appliance is tilted forward and having the fastening member engaging with the fixture panel, setting the cooking appliance at a third state in which the forward tilt is less than in the second state by rotating the cooking appliance about the fastening member from the second state, and fixing the cooking appliance attaining the third state to the fixture panel. In the step of fixing the cooking appliance attaining the third state to the fixture panel, the cooking appliance attaining the third state is supported using a predetermined member.

The cooking appliance is supported at the third state by a predetermined member in the transition from the second state to the third state.

Accordingly, the labor involved in the supporting job as to the supporting job and the attaching job required in the installment of the cooking appliance can be reduced. Therefore, the method of handling the cooking appliance easily can be provided.

In the method of installing the cooking appliance, the predetermined member is preferably a support base to support the cooking appliance attaining the third state.

The cooking appliance is supported at the third state by the support base in the transition from the second state to the third state. Therefore, the labor involved in the supporting job as to the supporting job and the attaching job required in the installment of the cooking appliance can be reduced.

In the method of installing the cooking appliance, the predetermined member is preferably a sub fastening member provided at the cooking appliance, and engaging with the fixture panel when the cooking appliance is at the third state.

The cooking appliance is supported at the third state by the engagement of the sub fastening member with the fixture panel in the transition from the second state to the third state.

Therefore, the labor involved in the supporting job as to the supporting job and the attaching job required in the installment of the cooking appliance can be reduced.

According to a further aspect of the present invention, a method of installing a cooking appliance having a fastening member engaging with a fixture panel fixed to a sidewall includes the steps of setting the cooking appliance at a first state in which the cooking appliance is tilted forward on a predetermined base in front of the sidewall, setting the cooling appliance at a second state from the first state in which the cooking appliance is tilted forward and having the fastening member being engaged with the fixture panel, and setting the cooking appliance at a third state in which the forward tilt is less than that in the second state by rotating the cooking appliance about the fastening member from the second state, and fixing the cooking appliance attaining the third state to the fixture panel. In the step of setting the cooking appliance at a first state, a support member supporting a cooling appliance attaining the first state is used.

In the step of setting the cooking appliance at the first state, the cooking appliance is supported at the first state by the support member.

Accordingly, the labor involved in the supporting job as to the supporting job and the attaching job required in the installment of the cooking appliance can be reduced. Therefore, a cooking appliance that can be handled easily can be provided.

In the method of installing the cooking appliance, the step of setting the cooking appliance at the second state preferably includes the step of sliding the cooking appliance on a predetermined base with a predetermined plate sandwiched between the predetermined base and the cooking appliance.

In sliding the cooking appliance on the predetermined base to attain the second state, a predetermined plate is sandwiched between the predetermined base and the cooking appliance.

This facilitates the sliding of the cooking appliance. Therefore, the labor involved in the supporting job as to the supporting job and the attaching job required in the installment of the cooking appliance can be reduced.

According to still another aspect of the present invention, a cooking appliance including an inlet to admit air into the cooking appliance and an outlet to exhaust air outside the cooking appliance has a cover that can be opened and closed extending over the inlet and the outlet.

When the operation of air input and output is not carried out in the cooking appliance, the inlet and the outlet can be covered by means of the cover.

Thus, the opportunity of dust and contamination being introduced into the cooking appliance can be reduced. A cooking appliance into which dust and contamination do not easily enter can be provided.

The cover preferably includes a partition member that prevents the air input into the cooking appliance through the inlet from being mixed with the air output from the cooking appliance through the outlet when the cover is open.

Accordingly, mixture of input air and output air can be prevented in the cooking appliance when the cover is open. Therefore, when air input and output is carried out for cooling the interior of the cooking appliance, introduction of the discharged warm air can be avoided to improve the cooling efficiency.

Further preferably, the cooking appliance includes a fan to input air through the inlet and to output air through the outlet, and a fan-oriented controller that controls the open/close state of the cover according to the operational status of the fan.

By virtue of the fan-oriented controller, the cover is automatically opened/closed according to the fan operational status.

Since the open/close state of the cover is switched automatically in an appropriate manner in the cooking appliance, the usability of the cooking appliance is improved.

Further preferably, the cooking appliance includes a heat unit for heating an object, and a heat-oriented controller for controlling the open/close state of the cover according to the operational status of the heat unit.

By virtue of the heat-oriented controller, the cover is opened/closed automatically according to the operational status of the heat unit.

Since the open/close state of the cover is switched automatically in an appropriate manner in the cooling appliance, usability thereof is improved.

According to a still further aspect of the present invention, a cooking appliance includes a heat unit for heating foodstuff, a controller for controlling the operation of the heat unit, and a casing enclosing the heat unit and the controller. The cooking appliance is attached to a fixture panel fixed to a sidewall. The cooking appliance includes an elongated aperture at the back side of the casing. An angle member fitting into the elongated aperture at the back side of the casing to support the casing is provided perpendicular at both sides of the fixture panel. Also, a hook supporting the bottom panel of the casing is provided at the lower edge portion of the fixture panel. An inclination portion and a horizontal portion continuous thereto are formed as a guide at the upper edge portion of the angle member to guide the upper edge obliquely upwards through the elongated aperture when the casing is to be attached to the fixture panel.

Preferably, the angle member includes an engage convex portion between the inclination portion and the horizontal portion to prevent the casing from being detached from the angle member through the elongated aperture.

According to yet a further aspect of the present invention, a method of installing a cooking appliance having a heat unit heating a foodstuff, a controller controlling the operation of the heat unit, and a casing enclosing the heat unit and the controller attached to a fixture panel fixed to a sidewall includes the steps of passing an angle member provided perpendicular at both sides of the fixture panel through an elongated aperture provided at the back side of the casing, moving the casing obliquely upwards along an inclination portion formed at the angle member, engaging an upper edge of the elongated aperture with an engage convex portion formed between the inclination portion and the horizontal portion of the angle member at the termination of the obliquely upward movement of the casing and supporting the bottom panel of the casing at the hook provided at the lower edge portion of the fixture panel, and setting the back side of the casing along the fixture panel by rotating the casing about the hook.

Further preferably, the method of installing a cooking appliance includes the step of moving the casing on a predetermined base having a slope upwards and obliquely along the inclination portion formed at the angle member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

(1) First Embodiment

Figure 1A:
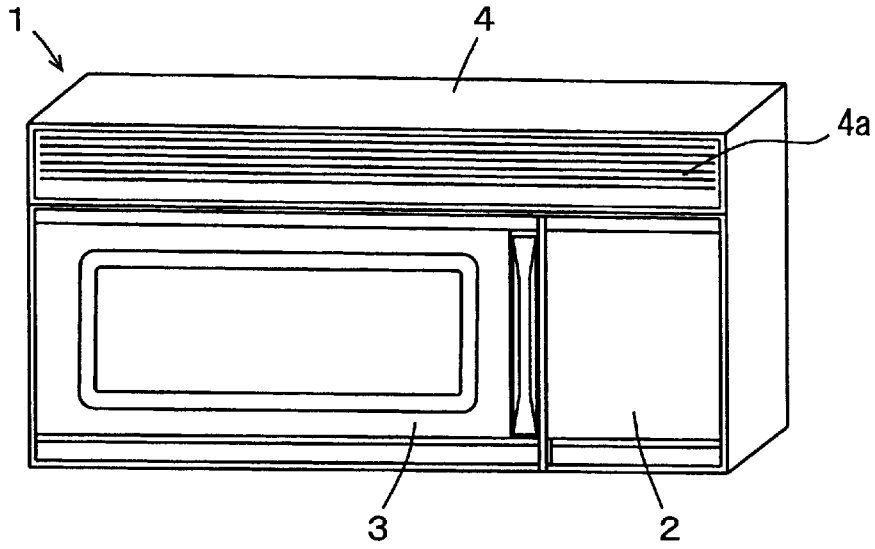
FIGS. 1A and 1B show a microwave oven according to an embodiment of the present invention.
Figure 1B:
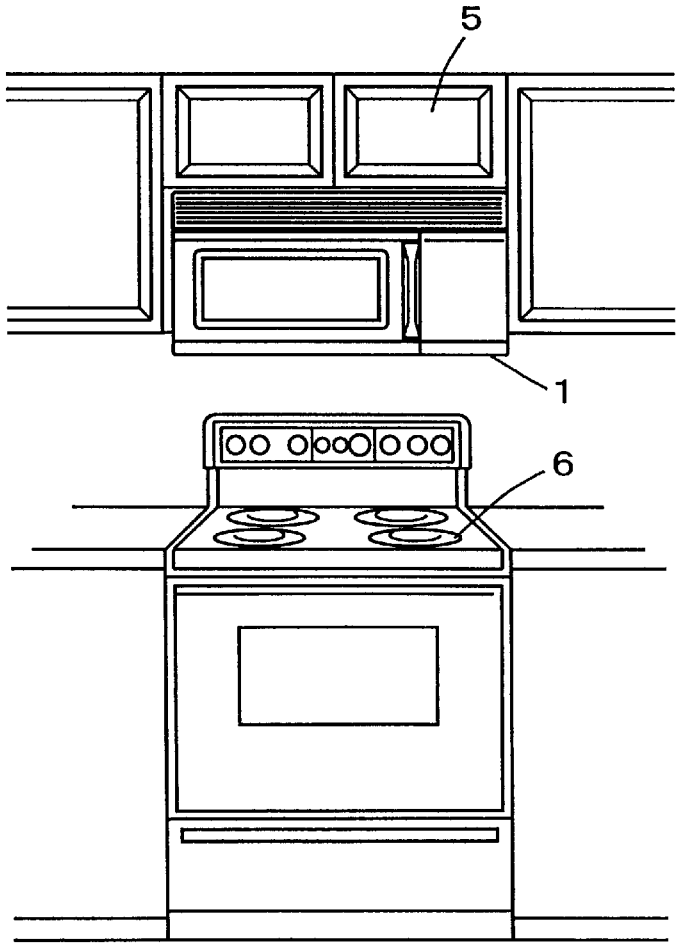

Referring to FIGS. 1A and 1B, a microwave oven 1 has its contour covered with a body frame 4. Microwave oven 1 includes a control panel 2, a door 3, and an air port 4*a* at the front. Microwave oven 1 is generally mounted within a cabinet 5 right above a gas range 6.

Figure 2A:
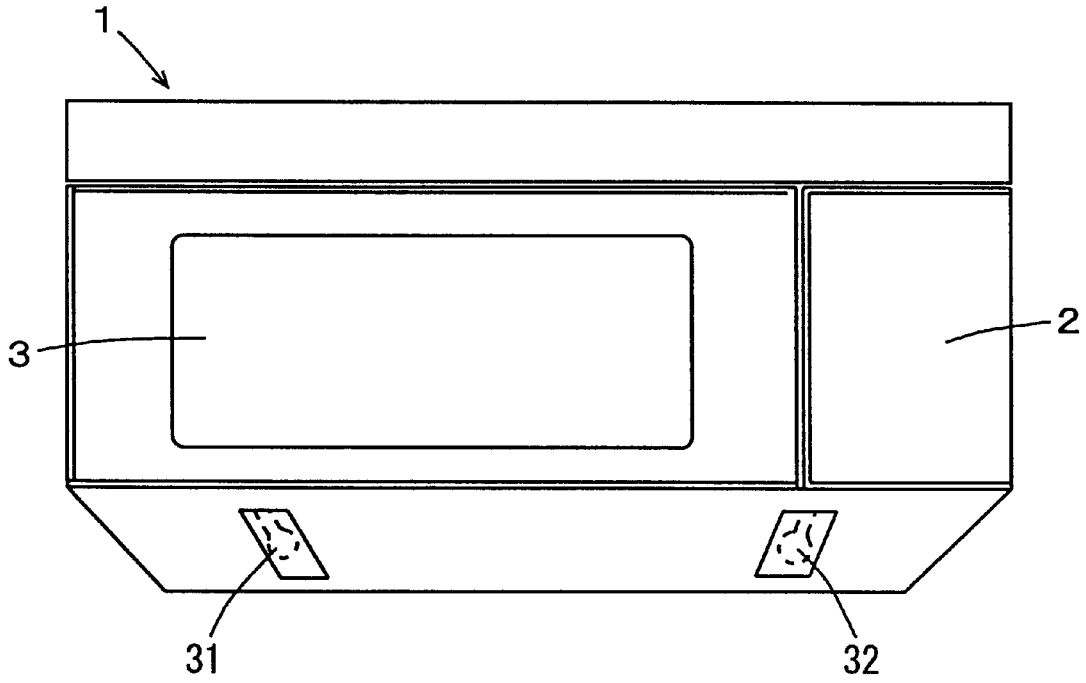
FIGS. 2A and 2B are diagrams to describe the structure of the microwave oven in detail.

Referring to FIG. 2A, a kitchen lamp 31 and a kitchen lamp 32 are provided at the bottom of microwave oven 1. The user can turn on kitchen lamps 31 and 32 during the cooking operation of gas range 6.

Figure 2B:
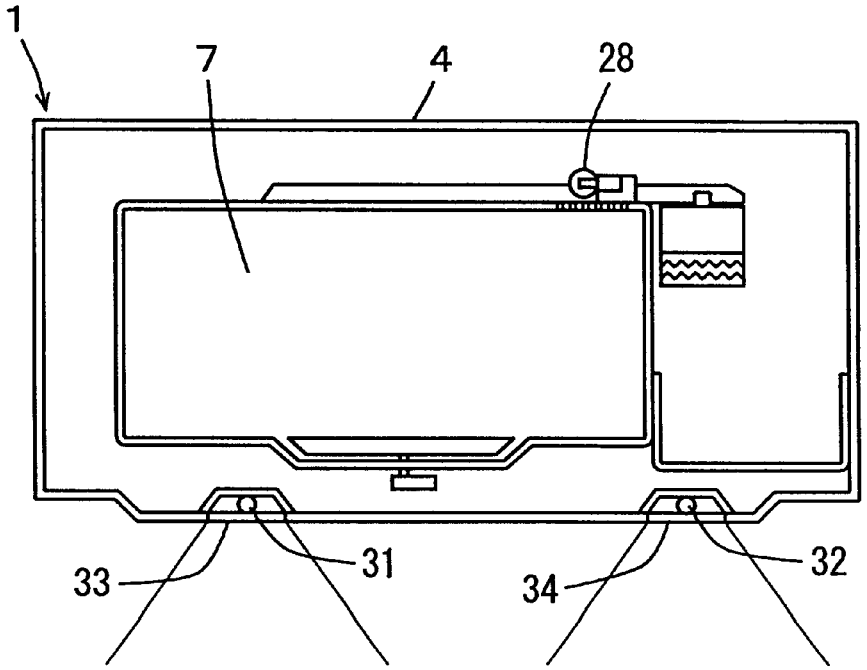

FIG. 2B is a diagram to describe the interior structure of microwave oven 1, with panel 2, door 3, and the front panel of air port 4*a* removed. Referring to FIG. 2B, a heat chamber 7 in which an object to be heated such as foodstuff is accommodated behind door 3. An interior lamp 28 is provided above heat chamber 7 to light up the interior of heat chamber 7. Heat resisting glass 33 and heat resistance glass 34 are provided beneath kitchen lamp 31 and kitchen lamp 32, respectively.

Figure 3:
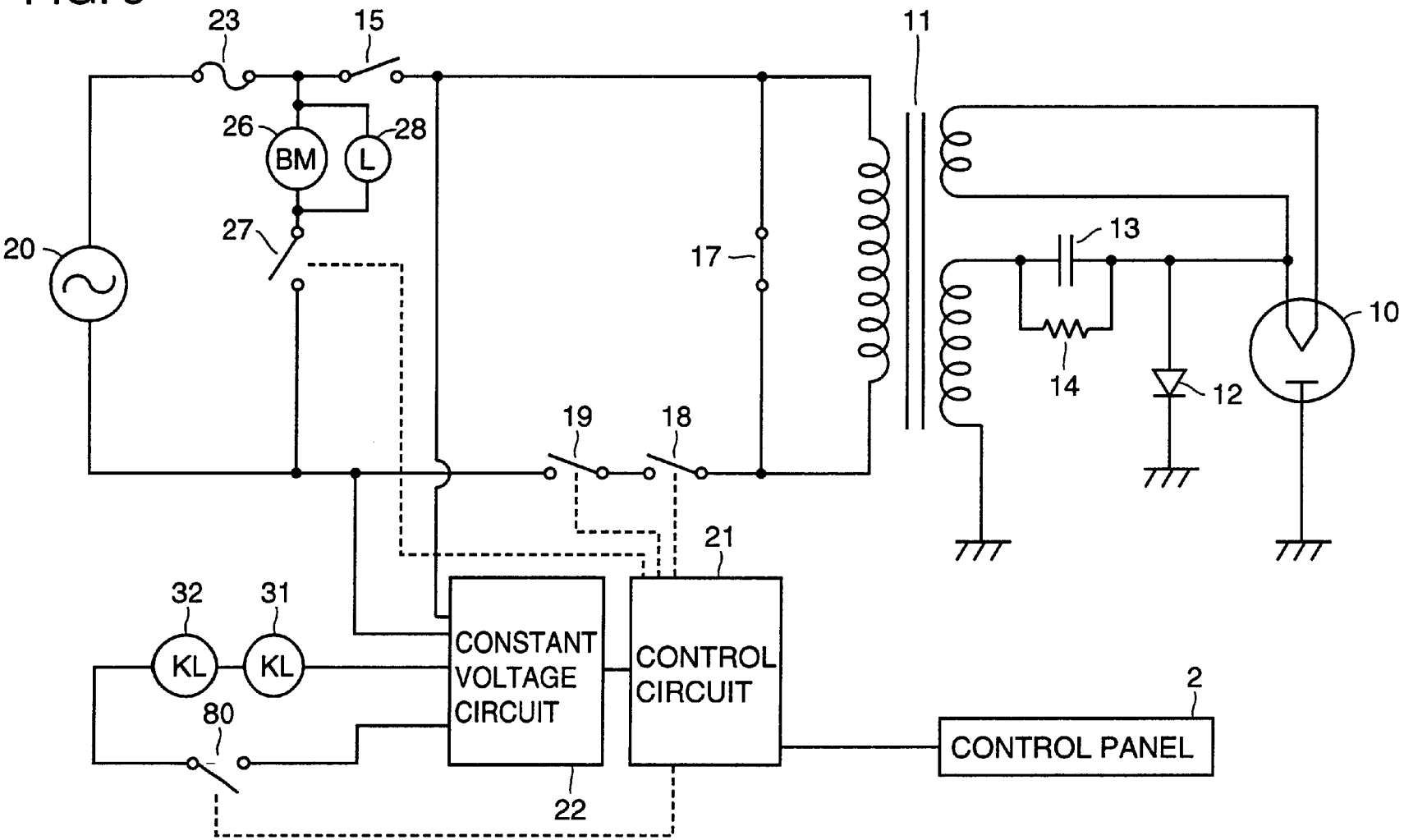
FIG. 3 schematically shows an electric circuit of the microwave oven.

FIG. 3 schematically shows the electrical circuit of microwave oven 1. Referring to FIG. 3, an AC power supply 20 supplies power to a magnetron 10, a high voltage transformer 11, a high voltage diode 12, and a high voltage capacitor 13 constituting the circuitry shown in FIG. 3. A half wave double voltage circuit is constituted by high voltage transformer 11, high voltage diode 12 and high voltage capacitor 13 to supply a high voltage (3–4 kV) to magnetron 10. 14 designates the discharge resistor discharging the charge accumulated at high voltage capacitor 13 after supply to magnetron 10 is ceased. As to discharge resistance 14, a resistor having a resistance so that discharge of high voltage capacitor 13 is completed by appropriately one minute after the power is cut is employed.

A door switch 15 is provided to open and close the circuitry shown in FIG. 3 when door 3 is open and closed, respectively. Therefore, microwave oven 1 is implemented to inhibit generation of an electric wave from magnetron 10 when door 3 is open since the circuitry is open by door switch 15. Supply of current from AC power supply 20 to transformer 11 is suppressed in this way.

18 and 19 designate an output adjustment relay and a main relay regulating energization of magnetron 10, respectively, for the heat cooking operation. Main relay 19 is ON during the heating operation. Output adjustment relay 18 is repeatedly turned on/off during the heating operation to adjust the output of magnetron 10. The on/off operation of output adjustment relay 18 and main relay 19 is under control of control circuit 21.

Control circuit 21 includes a microcomputer and a memory not shown. Control circuit 21 turns on/off main relay 19 and output adjustment relay 18 according to the cooking menu input by the user through control panel 6 by the microcomputer. Control circuit 21 stores the cooking information such as the heating time, if necessary, into the memory. 22 designates a constant voltage circuit supplying power of a constant voltage to control circuit 21.

17 designates a monitor switch functioning in a manner opposite to door switch 15. More specificaily, monitor switch 17 is implemented to close and open the circuitry shown in FIG. 3 when door 3 is opened and closed, respectively. Monitor switch 17 functions to form a short-circuit to cut a fuse 23 to avoid energization towards magnetron 10 when door switch 15 does not open the circuitry due to some cause even when door 3 is opened. Thus, the dangerous status of magnetron 10 emitting an electric wave of high frequency with door 3 open can be obviated.

26 designates a blower motor to drive the cooling fan of magnetron 10. 28 designates an interior lamp lighting the interior of heat chamber 7. 27 designates a relay switch controlling energization towards blower motor 26 and interior lamp 28. Relay switch 27 is turned on/off under control of control circuit 21.

Kitchen lamps 31 and 32 are connected to constant voltage circuit 22. 80 designates a relay switch controlling energization towards kitchen lamp 31 and 32. Relay switch 80 is turned on/off under control of control circuit 21 in response to a predetermined manipulation by the user through control panel 60.

Figure 4:
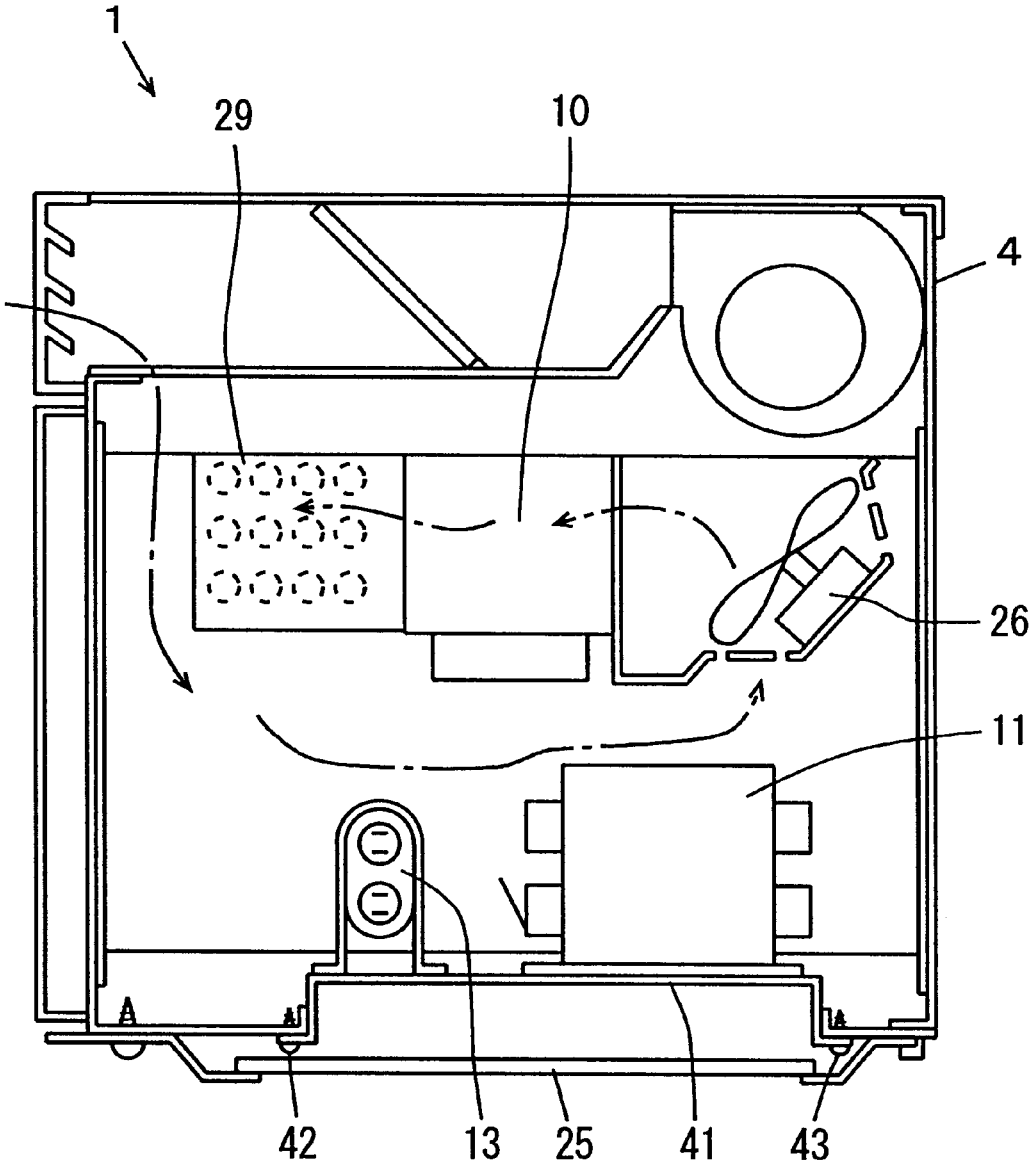
FIG. 4 is a diagram to describe in detail the structure of the microwave oven.

FIG. 4 is a diagram to describe the structure of microwave oven 1 of FIG. 1 in detail. FIG. 4 is a side view of microwave oven 1 with the right end portion of body frame 4 removed.

Upon initiation of the operation of blower motor 26 in microwave oven 1 of FIG. 4, air is admitted from the front of microwave oven 1 to result in air flow from blower motor 26 towards magnetron 10 and a duct 29, as indicated by the chain dotted arrow. Duct 29 communicates with heat chamber 7. The air flowing into duct 29 is sent to the interior of heat chamber 7. By this air flow, high voltage capacitor 13, high voltage transformer 11 and magnetron 10 are cooled during the cooking operation using magnetron 10 in microwave oven 1.

Many of the electronic components forming the circuitry shown in FIG. 3 such as high voltage transformer 11 and high voltage capacitor 13 are provided on a bottom panel 41 forming the bottom of body frame 4 at the bottom of microwave oven 1. A filter 25 is fitted under bottom panel 41 in microwave oven 1. By removing filter 25 and small screws 42 and 43, bottom panel 41 can be moved downwards to be detached from body frame 4 of microwave oven 1. By removing bottom panel 41 from body frame 4 of microwave oven 1, many of the electronic components forming the circuitry shown in FIG. 3 such as high voltage transformer 11 and high voltage capacitor 13 can be detached from the main body of microwave oven 1. Since bottom panel 41 can be removed from the main body of microwave oven 1, the electronic components of microwave oven 1 can be easily detached from the body of microwave oven 1.

Electronic components such as magnetron 10 that are not provided on bottom panel 41 can also be easily detached by removing filter 25 and bottom panel 41. More specifically, the workman can insert one's hand from the bottom of microwave oven 1 to remove a relevant component.

Since many electronic components can be detached from below microwave oven 1, repair of an electronic component of microwave oven 1 is facilitated when microwave oven 1 is attached at a high location as shown in FIG. 1B.

The method of installing microwave oven 1 at a high position as shown in FIG. 1B will be described hereinafter.

Figure 5:
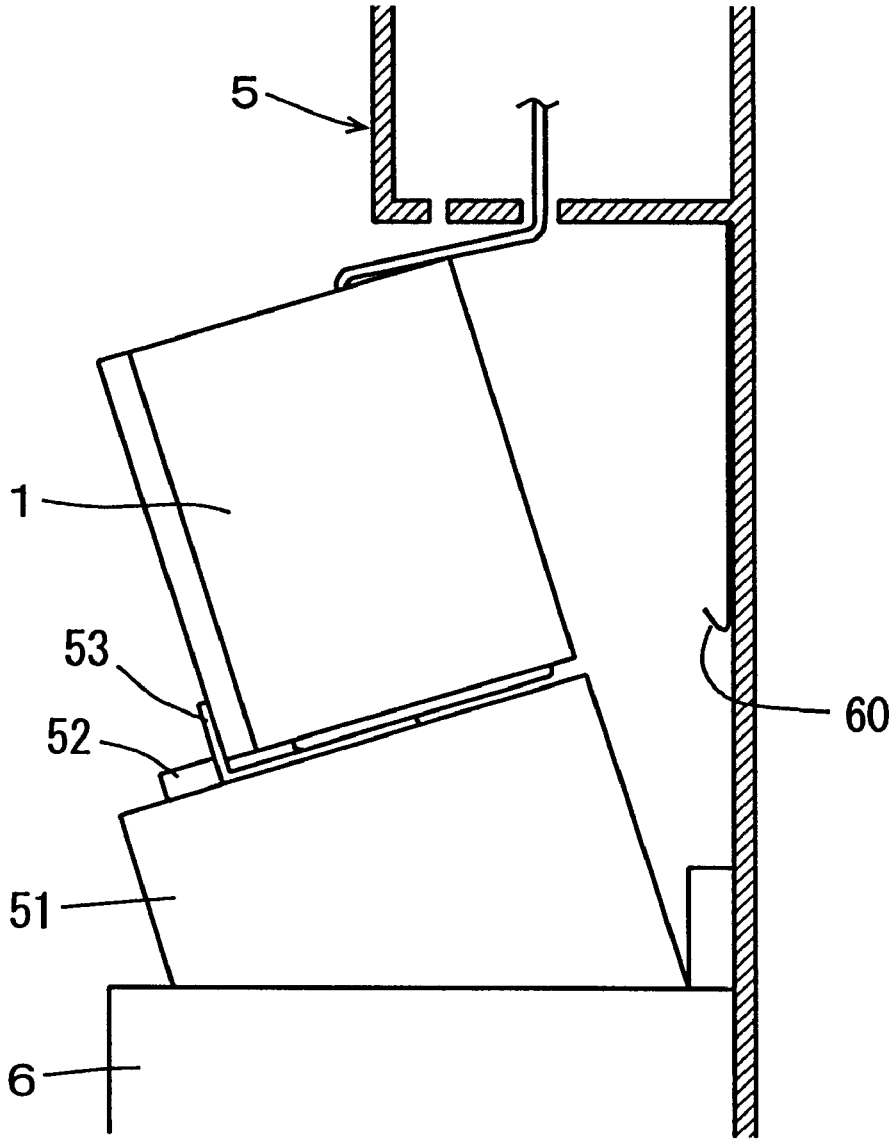
FIGS. 5–7 are diagrams to describe installment of the microwave oven at a high position.

Referring to FIG. 5, a support base 51 is placed on gas range 6 to tilt microwave oven 1 forward in front of cabinet 5 in installing microwave oven 1 at cabinet 5. A member 52 supporting microwave oven 1 in a forward tilting posture at the front side on support base 51 is provided. Microwave oven 1 is supported to avoid sliding off support base 51 by virtue of member 52.

Figure 6A:
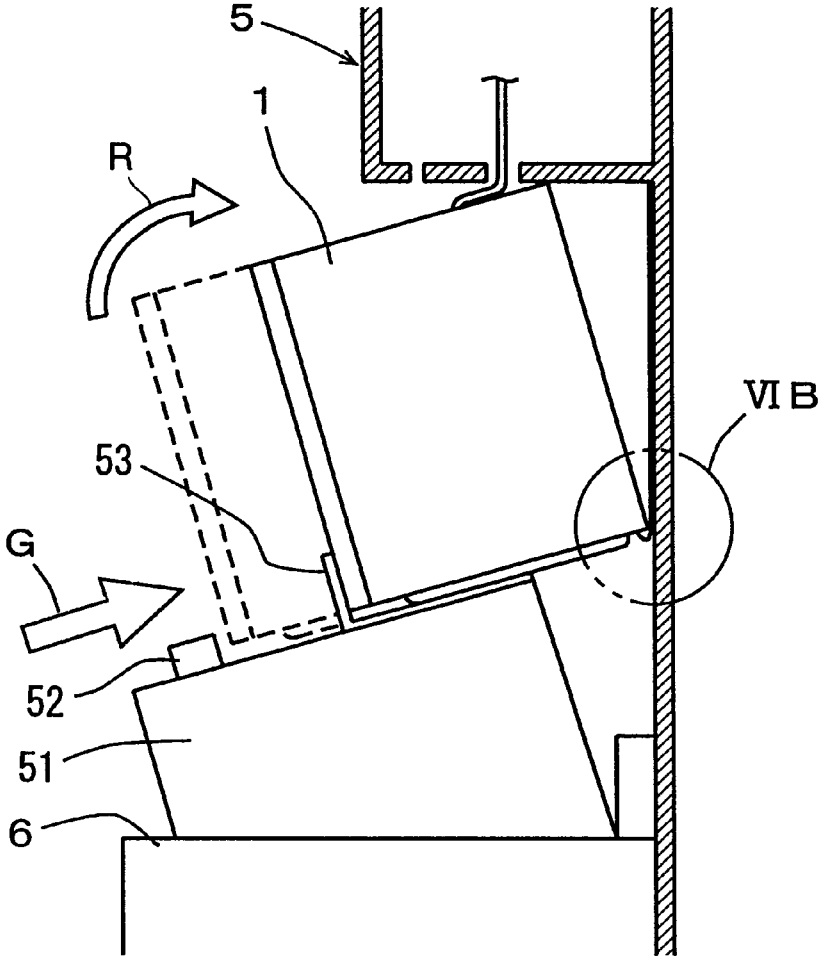
Figure 6B:
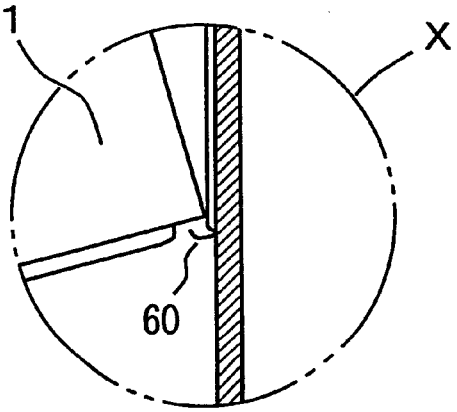

The workman then slides microwave oven 1 on support base 51 towards cabinet 5 (in the direction of arrow G in FIG. 6) from the stage shown in FIG. 5, whereby the rear lower portion of microwave oven 1 is to be caught on a hook 60 provided on the wall of cabinet 5. FIG. 6A corresponds to this state. In the present embodiment, an underlying panel 53 is inserted between support base 51 and microwave oven 1 to slide microwave oven 1. This facilitates the slide of microwave oven 1 on support base 51. Therefore, the sliding job can be carried out more easily. Underlying panel 53 is formed of, for example, cardboard and the like. The state of the rear lower end of microwave oven 1 caught on hood 60 is represented by a region VIB in FIG. 6A. FIG. 6B corresponds to an enlarged view of region VIB.

Figure 7:
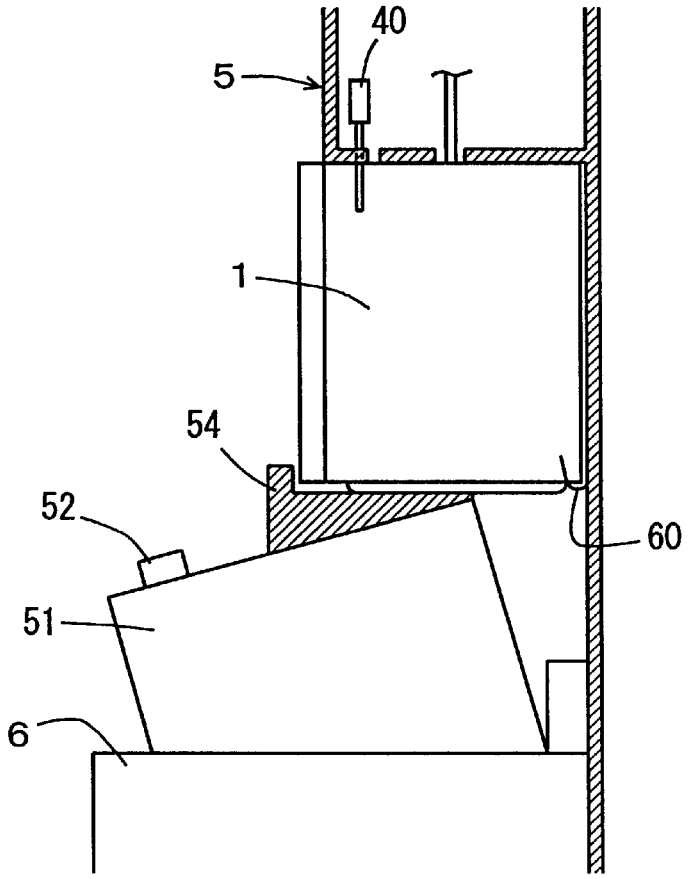

Next, the workman rotates microwave oven 1 in the direction of arrow R about the contact between hook 60 and microwave oven 1 within region VIB, as shown in FIG. 6A. As a result, microwave oven 1 takes a posture facing the front, as shown in FIG. 7. Microwave oven 1 is secured to cabinet 5 by means of a small screw in the front-facing state. Thus, the installment job of microwave oven 1 to cabinet 5 is completed. In order to secure microwave oven 1 at the front-facing state in the fixing operation by means of the small screw, a driver 40 is inserted into a hole provided at a predetermined position in microwave oven 1 through an opening provided at a predetermined position in cabinet 5. Also, an insert member 54 is fitted between microwave oven 1 and support base 51 to fix microwave oven 1 at the front-facing state in the fixing operation by means of the small screw. Little, if any, force is required by the workman to support microwave oven 1 in the fixing operation through the small screw. Therefore, the workman can mount microwave oven 1 at cabinet 5 more easily.

Support base 51, member 52 and underlying panel 53 used in installing microwave oven 1 can be formed of a cardboard that is used for the package of microwave oven 1. The procedure of preparing support base 51, upright member 52, and underlying panel 53 from the cardboard box will be described hereinafter.

Figure 8:
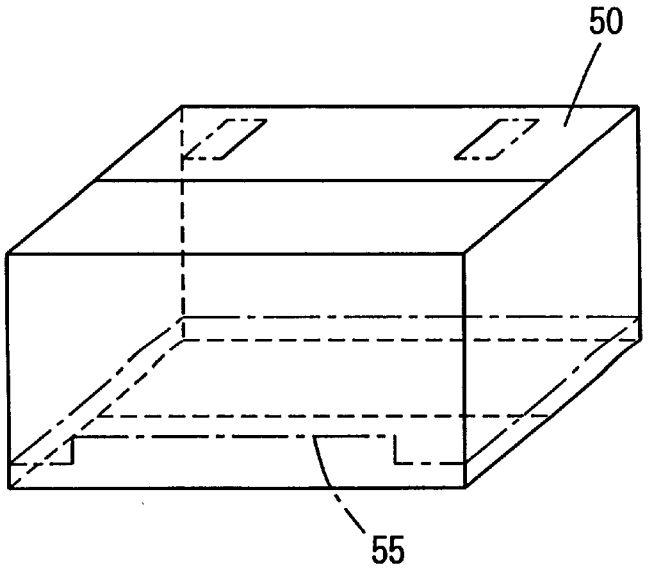
FIG. 8 is a diagram to describe the procedure of preparing a support base, an upright portion, and an underlying panel used in installing the microwave oven.
Figure 9A:
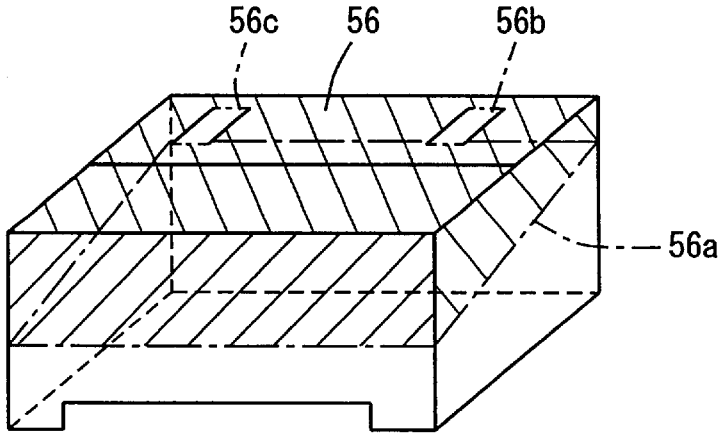
FIGS. 9A and 9B are diagrams to describe the procedure of preparing a support base, an upright portion, and an underlying panel used in installing the microwave oven.

Referring to FIG. 8, the lower portion of cardboard box 50 is cut along a cut away line 55. Accordingly, cardboard box 51 is divided into an upper portion 56 shown in FIG. 9A and a lower portion 57 shown in FIG. 9B. Referring to FIG. 9A, upper portion 56 is cut along a cut away line 56*a*. The upper portion thereof corresponds to support base 51 shown in FIG. 10A. By providing a cut according to a cut line 56*b* and a cut line 56*c* at the upper face of upper portion 56 of FIG. 9A, and bending up the cut portion, two upright members 52 as shown in FIG. 10A are provided in support base 51.

Figure 9B:
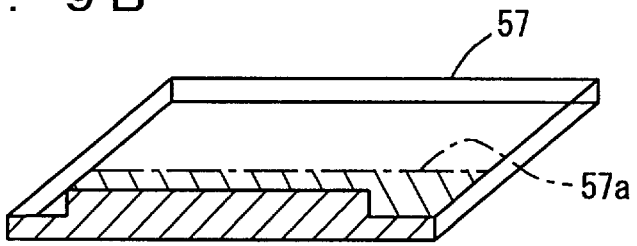
Figure 10A:
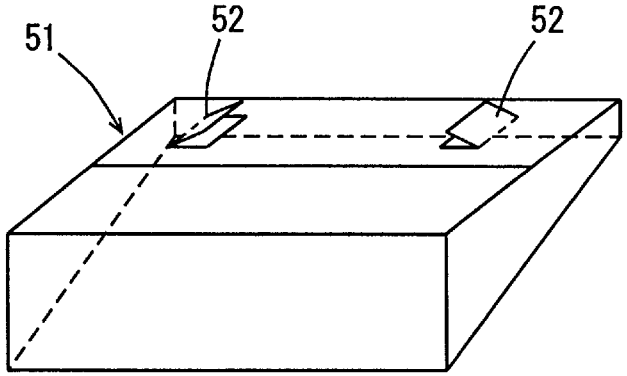
FIGS. 10A and 10B are diagrams to describe the procedure of preparing a support base, an upright portion, an underlying panel, and an insert member used in installing the microwave oven.
Figure 10B:
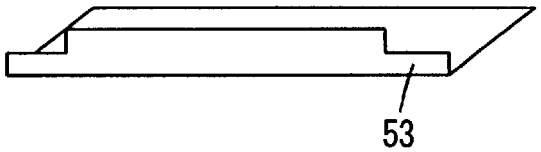

Lower portion 57 of FIG. 9B is further cut along a cut away line 57*a*. The front portion thereof corresponds to underlying panel 53, as shown in FIG. 10B.

Insert member 54 can be formed using expanded polystyrene or the like employed to fill the gap between the cardboard box and microwave oven 1 in the package of microwave oven 1.

Figure 11:
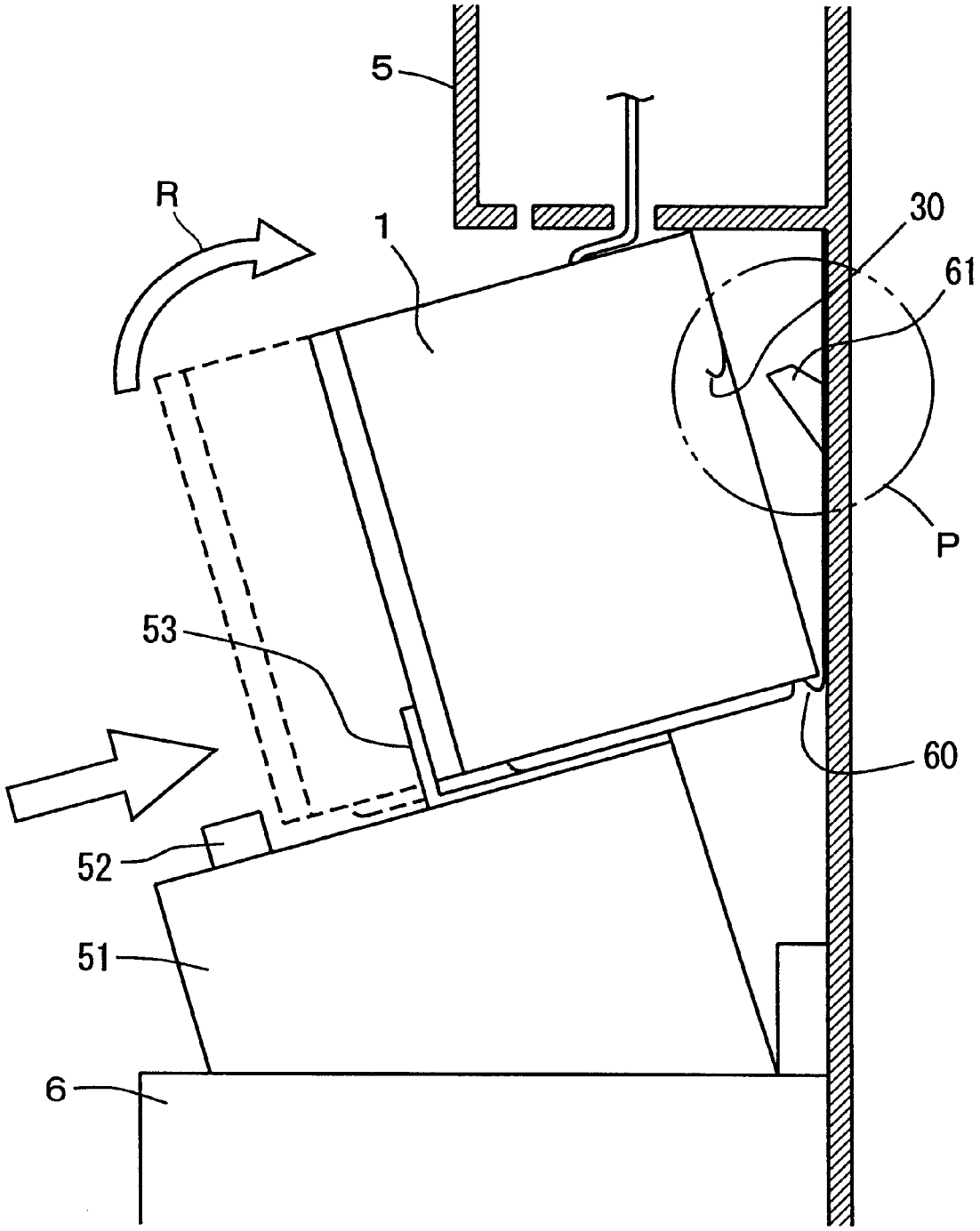
FIGS. 11–12 are diagrams to describe a modification of installing a microwave oven at a high position.
Figure 12:
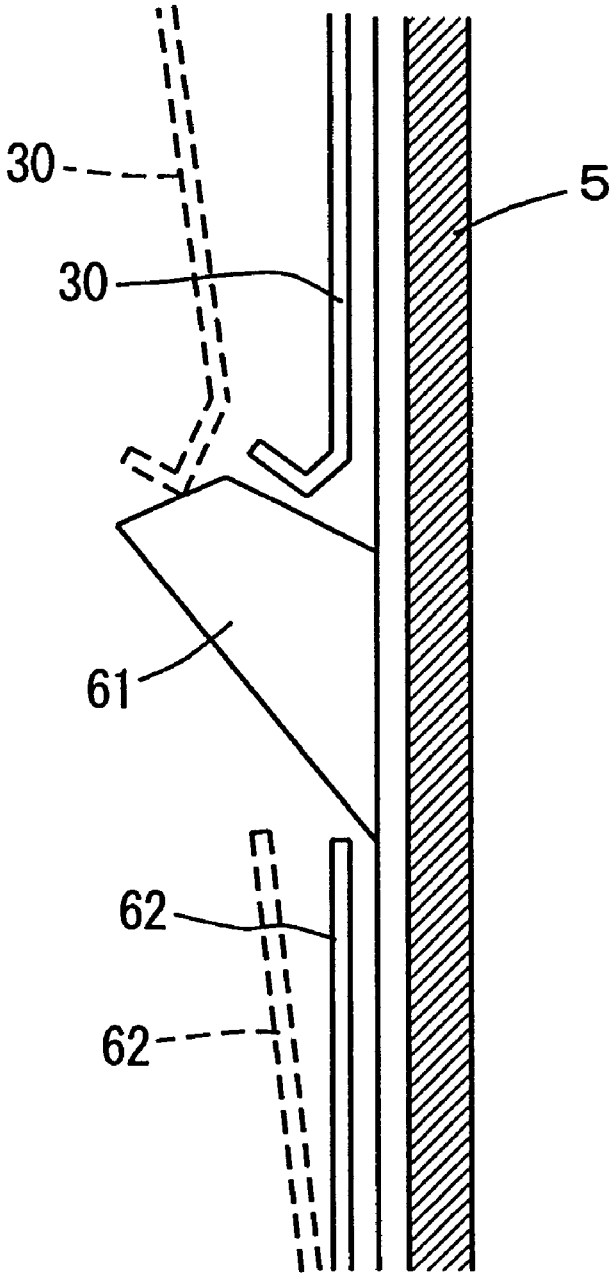

A modification of the method of installing microwave oven 1 at cabinet 5 will be described hereinafter. In the previous installment of microwave oven 1, microwave oven 1 facing the front was supported by an insert member 54 as shown in FIG. 7. The present invention is not limited to this embodiment. For example, a hook 30 can be provided at the back side of microwave oven 1. Also, an engage member 61 can be provided at a predetermined position on cabinet 5 corresponding to hook 30, as shown in a region P in FIG. 11. By these members, hook 30 engages with engage member 61 when microwave oven 1 is pivoted in the direction of R from the state shown in FIG. 11 about the contact with hook 60. By virtue of this engagement, microwave oven 1 is supported in a front-facing posture even if insert member 54 is absent. FIG. 12 represents an enlarged view of the engagement between hook 30 and engage member 61. In FIG. 12, the engaging state of hook 30 and engage member 61 is represented by the solid line. The state right before engagement is represented by the broken line. Hook 30 and engage member 61 attain the state indicated by the solid line when microwave oven 1 is set at the state of FIG. 7 facing the front.

Figure 13:
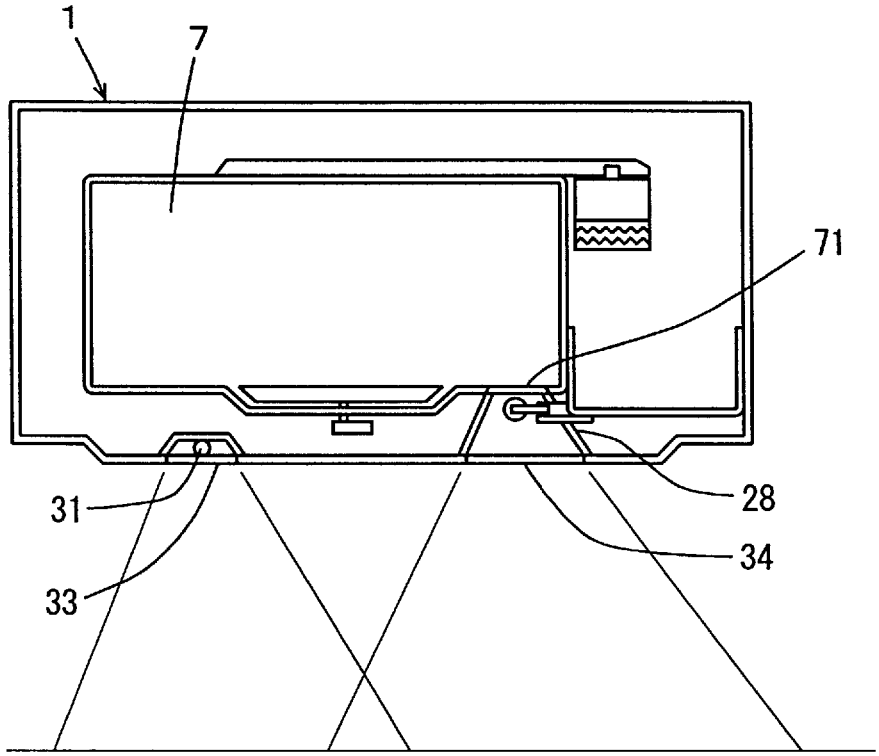
FIG. 13 shows a modification of a microwave oven.

A modification of the structure of microwave oven 1 per se will be described. As described with reference to FIG. 2B, microwave oven 1 includes the three lamps of kitchen lamp 31, kitchen lamp 32, and interior lamp 28. Kitchen lamp 32 is dispensable by mounting interior lamp 28 below heat chamber 7, as shown in FIG. 13. Since interior lamp 28 must light heating chamber 7 from below of heat chamber 7, a portion of the bottom (corresponding to interior lamp 28) of heat chamber 7 must be formed of a transparent material such as heat resisting glass 71. Since the number of lamps of microwave oven 1 can be reduced by this structure, microwave oven 1 can be fabricated at a lower cost.

(2) Second Embodiment

Figure 14:
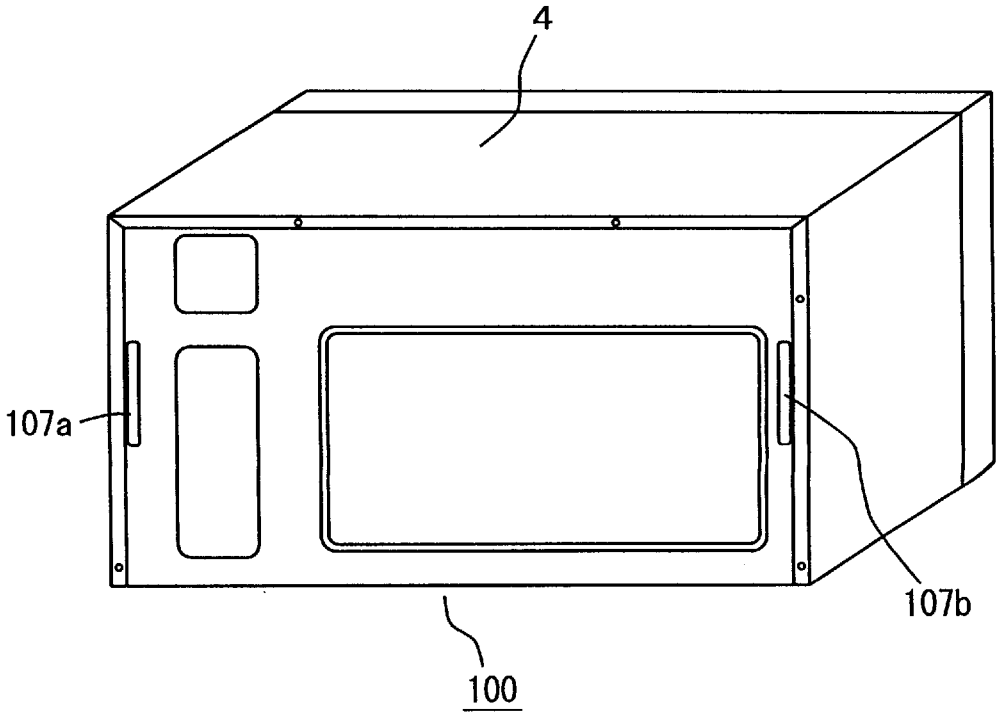
FIG. 14 is a perspective view of a structure of a microwave oven according to a second embodiment of the present invention.

FIG. 14 is a perspective view of a microwave oven 1 according to the second embodiment of the present invention, viewed from the back side. Referring to FIG. 14, one pair of elongated apertures 107*a* and 107*b* are formed at both side ends at the back face of microwave oven 100. Each elongated aperture has the longer size running in the vertical direction.

An installment structure and a method of installing microwave oven 100 at a high location as shown in FIG. 1 will be described hereinafter.

Figure 15:
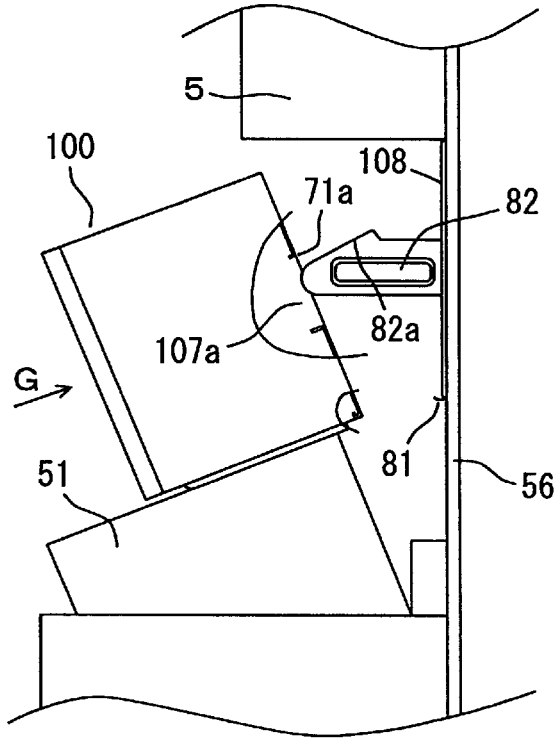
FIGS. 15–19 are side views of the microwave oven of the second embodiment to describe installment at a high position.

Referring to FIG. 15, when microwave oven 100 is to be attached to cabinet 5, support base 51 for tilting microwave oven 1 forward in front of cabinet 5 is placed on gas range 6, likewise the first embodiment.

Only one workman is required to slide microwave oven 1 on support base 51 towards cabinet 5 (in the direction of arrow G in FIG. 15) from the state of FIG. 15. An upper edge inclination portion 82*a* of an angle member 82 provided perpendicularly at both side edges of a fixture panel 108 fixed at a wall 56 of the kitchen in the proximity of cabinet 5 passes through respective elongated apertures 107*a* and 107*b* at the back side of microwave oven 100, whereby an upper edge 71*a* of the elongated aperture slides on upper edge inclination portion 82*a*. A hook 81 engaging with the back lower portion of microwave oven 100 is provided at wall 56, likewise the first embodiment.

Support base 51 is formed of a cardboard box used for packaging microwave oven 1, likewise the first embodiment.

Accordingly, microwave oven 1 moves upwards obliquely while sliding on support base 51 with the back side pulled upwards by upper edge inclination portion 82*a* of angle member 82.

Figure 16:
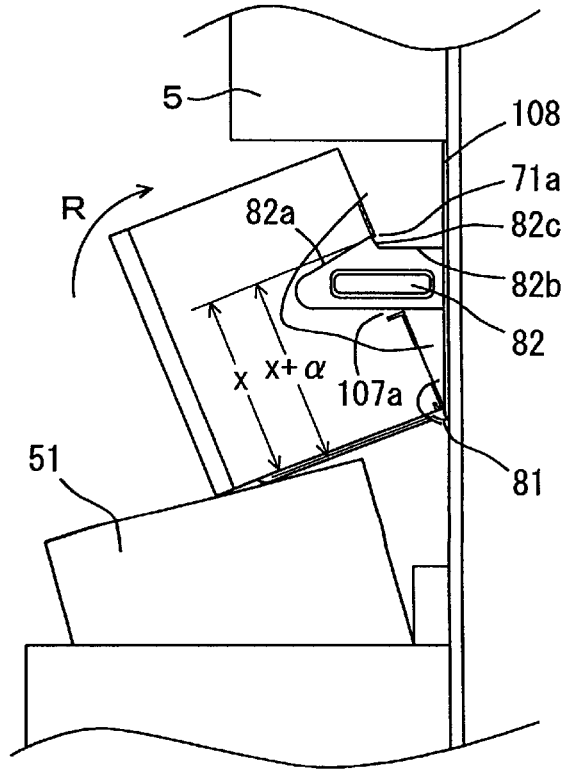

FIG. 16 shows the final state of microwave oven 100 in the travel of the oblique direction. Here, the lower portion at the back side of microwave oven 100 abuts against the lower edge of fixture panel 108. Here, the distance from the lower end of the back face of microwave oven 100 to an engage convex portion 82*c* located between upper edge inclination portion 82*a* and horizontal portion 82*b* is X. The distance from hook 81 to engage convex portion 82*c* is X+α. Therefore, the lower end of the back side of microwave oven 1 is located upper of hook 81.

Figure 17:
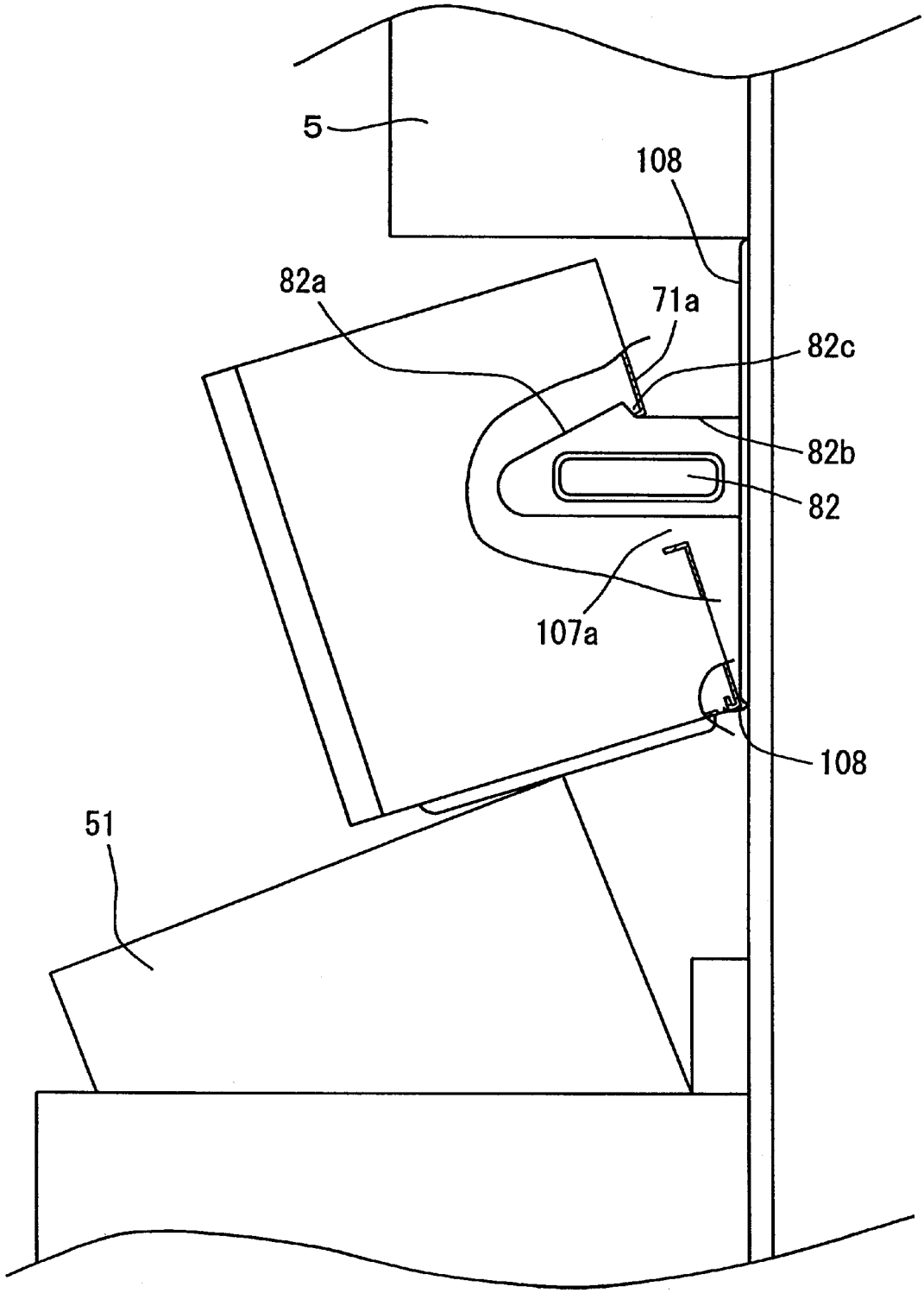

By rotating microwave oven 100 in the direction of arrow R with the lower end of the back side of microwave oven 1 as the fulcrum, the lower end of the back side of microwave oven 100 descends by distance α. As a result, upper edge portion 71*a* of elongated aperture 7*a* engages with engage convex portion 82*c* located between upper edge inclination portion 82*a* and horizontal portion 82*b* of angle member 82, as shown in FIG. 17.

Therefore, microwave oven 100 is provisionally secured by angle member 82 and hook 81 in this state. Microwave oven 100 will not fall off even when the workman releases one's hand.

Figure 18:
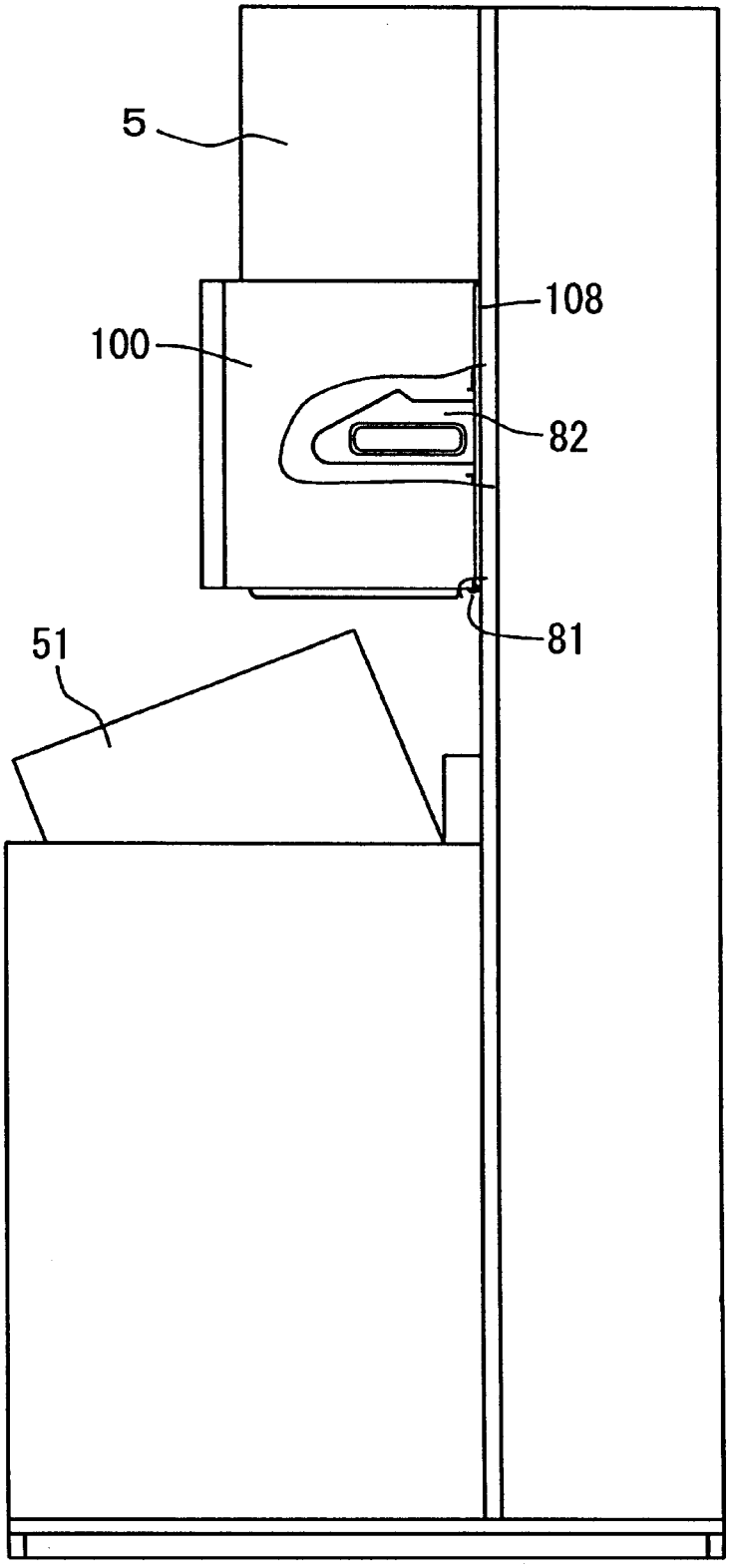
Figure 19:
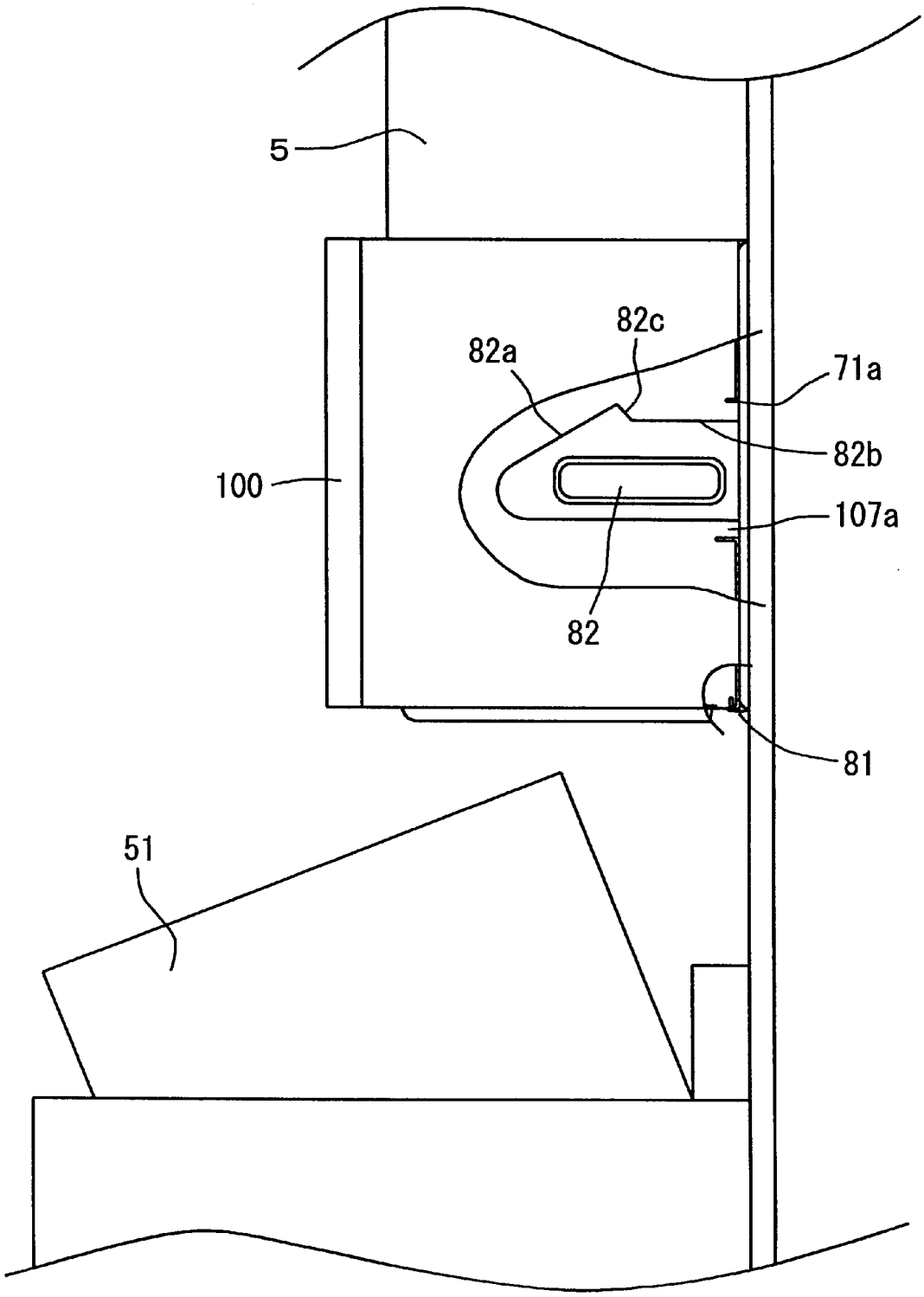

Then, microwave oven 100 is pivoted downwards with upper edge portion 71*a* of elongated aperture 107*a* sliding along horizontal portion 82*b* of angle member 82. Thus, the back face of microwave oven 100 exactly fits along fixture panel 108, as shown in FIGS. 18 and 19.

By securing the upper panel of body frame 4 of microwave oven 100 to the bottom panel of cabinet 5, the installment process is completed.

(3) Third Embodiment

The cooking appliance according to the third embodiment of the present invention is not limited to the high-placement type microwave oven shown in the first and second embodiments, and may be a movable microwave oven that is not attached to a predetermined position. The present embodiment is applicable to any cooking appliance that admits air inside and discharges air outside.

Figure 20:
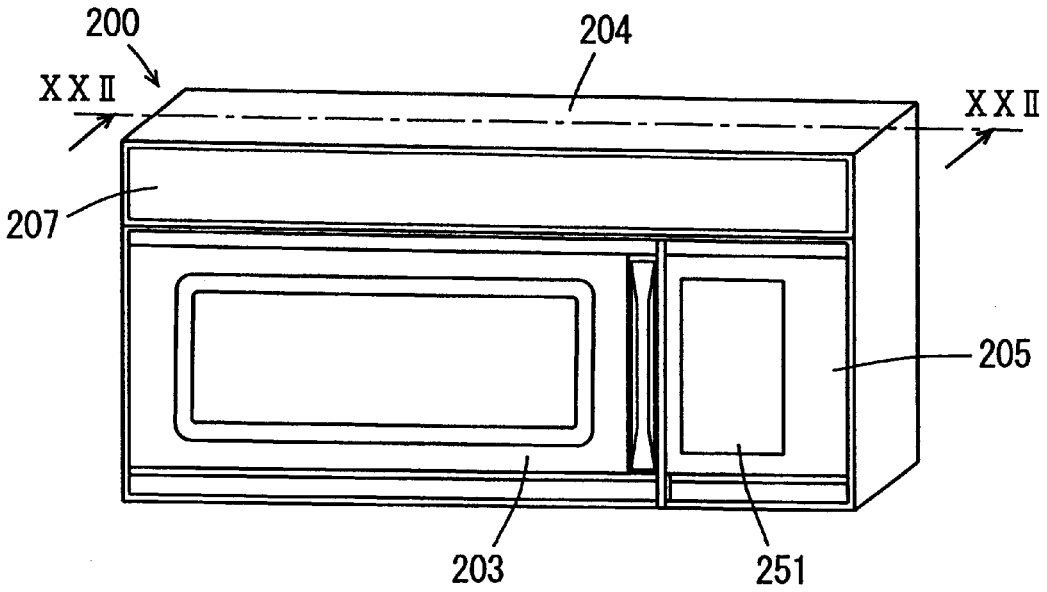
FIG. 20 shows a microwave oven according to a third embodiment of the present invention.

FIG. 20 shows a microwave oven 200 according to the third embodiment of the present invention. Referring to FIG. 20, microwave oven 200 includes a front panel 205 and a door 203 at the front face of a main body 204. An inlet and an outlet (not shown, corresponding to an inlet 221 and an outlet 222 described afterwards) are provided above front panel 206. A cover 207 is provided extending over the inlet and the outlet. A control panel 251 through which the user enters a manipulation of microwave oven 200 is provided at front panel 205. Microwave oven 200 is installed right above a gas range in a cabinet in a kitchen shown in, for example, FIG. 2, likewise the first and second embodiments.

Figure 21:
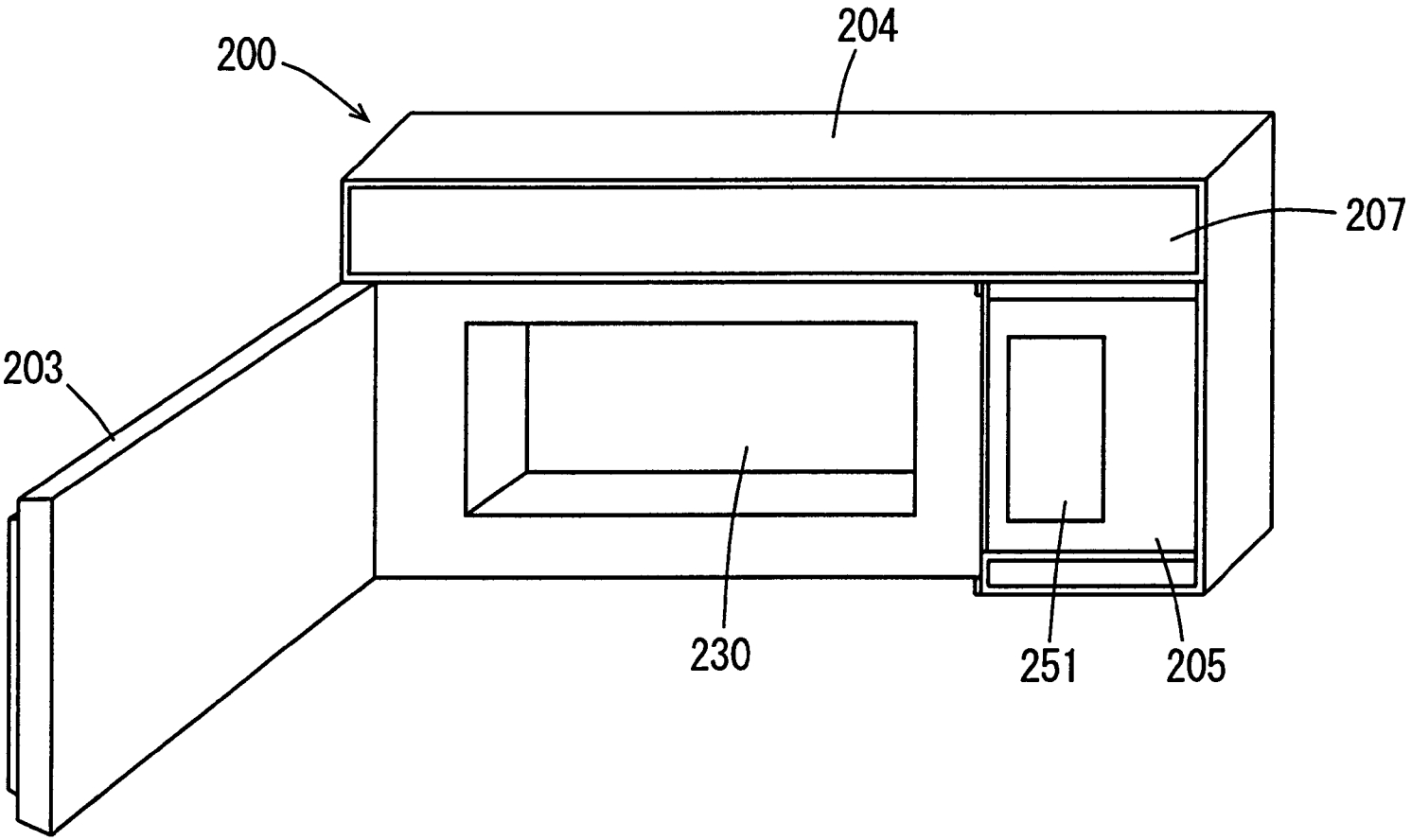
FIG. 21 shows the microwave oven of FIG. 20 with the door open.

FIG. 21 shows microwave oven 200 of the third embodiment with door 203 open. A heat chamber 230 accommodating an object to be heated is provided within main body 204 and behind door 203.

Figure 22:
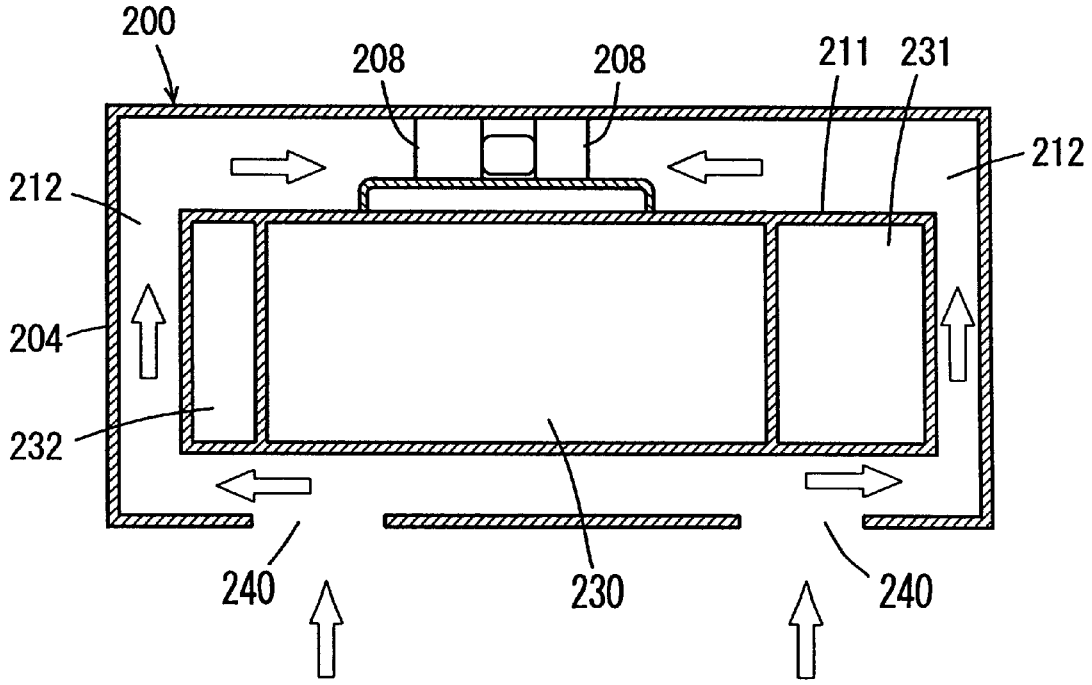
FIG. 22 is a sectional view of the microwave oven of FIG. 20 taken along line XXII–XXII.
Figure 23:
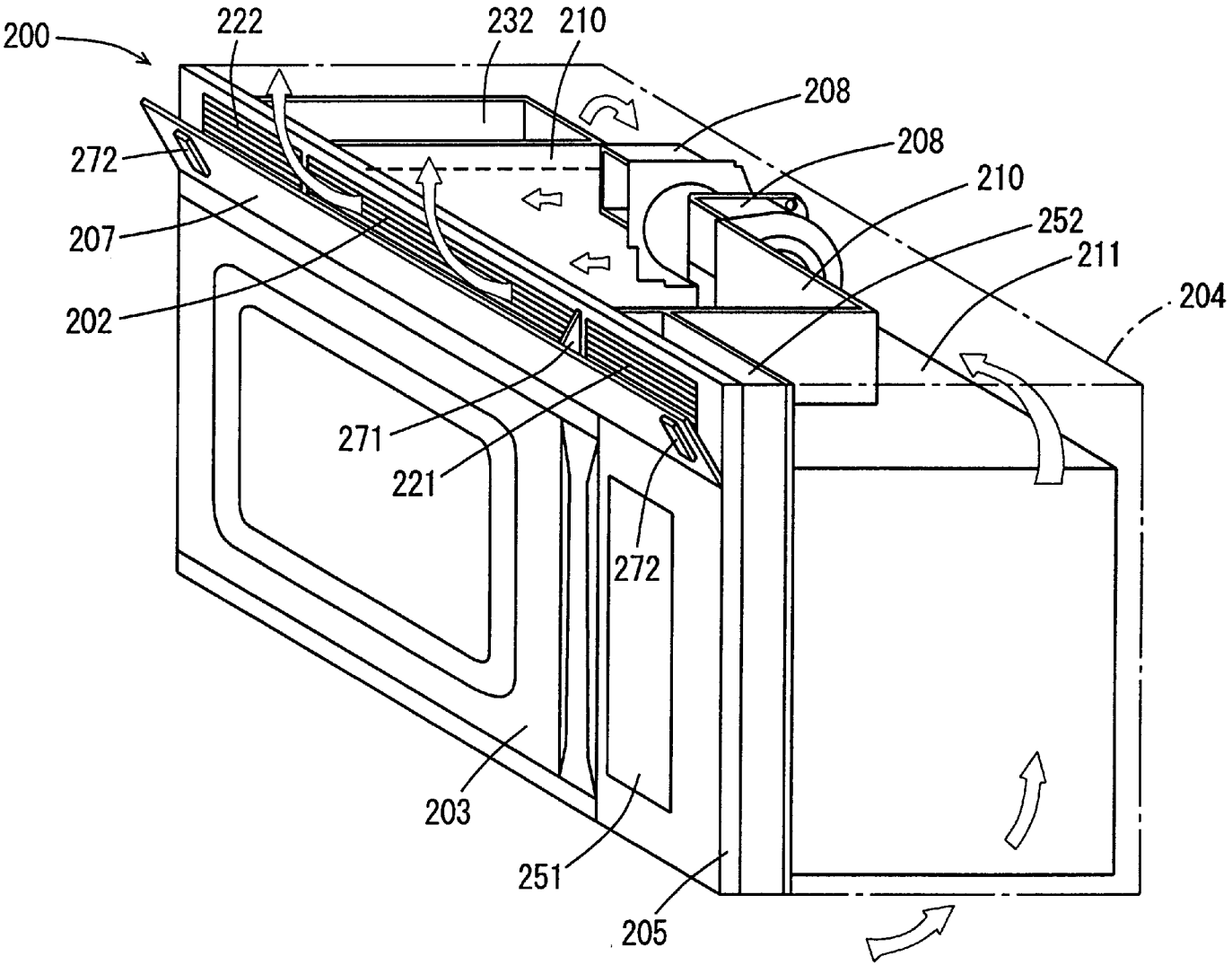
FIGS. 23 and 24 are perspective views of the microwave oven of the third embodiment.

FIG. 22 is a sectional view of microwave oven 200 taken along line XXII–XXII of FIG. 21. FIG. 23 is a perspective view of microwave oven 200, with the contour of main body 204 omitted for the sake of describing the interior of microwave oven 200.

Referring to FIGS. 22 and 23, microwave oven 200 includes an intermediate frame 211 and an air channel 212 at the outer side of intermediate frame 211, both within main body 204. Intermediate frame 11 is formed to enclose heat chamber 230, a machine chamber 231 accommodating electronic components for heat control (such as a magnetron 233), and an exhaust chamber 232 into which air exhausted from heat chamber 230 is introduced. An outlet 240 is provided at a wall of air channel 212 and at the bottom face of main body 204. Two hood fans 208 are provided above intermediate frame 211. Also, inlet 221 and outlets 202 and 222 over which cover 207 extends are provided at the upper portion of front panel 205. A body guide 210 is provided to guide the air from hood fan 208 exclusively to outlet 202.

When hood fan 208 is actuated in microwave oven 200, cover 207 attains an open state shown in FIG. 23 from the closed state shown in FIG. 20. Air is admitted into air channel 212 from inlet 240, as shown by the open arrow in FIGS. 22 and 23. The air is discharged outside microwave oven 200 from outlet 202 through hood fan 208. By virtue of the provision of cover 207 at the front of outlet 202, air can be discharged upwards from outlet 202. More specifically, cover 207 controls the flowing direction of air discharged from outlet 202 (and outlet 222). By the input of air from inlet 240 and output of air from outlet 202 in microwave oven 200, microwave oven 200 can be used as a ventilator when cooking is carried out by gas range 6.

A partition panel 271 and a knob 272 are provided at cover 207. Partition panel 271 is provided to avoid the air discharged from outlet 202 from being admitted into microwave oven 200 directly through inlet 221. Knob 272 is provided to open/close cover 207 manually. The provision of knob 272 allows cover 207 to be opened/closed manually without having to actuate hood fan 208 and fan 234 in the case where the neighborhood of inlet 221 and outlets 202 and 222 is to be cleaned or when the operation of automatically opening/closing cover 207 fails. In the present embodiment, a partition member is implemented by partition panel 271 to prevent mixture of the air admitted into microwave oven 200 through the inlet and the air discharged outside microwave oven 200 via the output when cover 207 is open. Although the partition member of the present embodiment is a panel such as partition panel 271, any shape is allowed as long as air mixture can be prevented.

Referring to FIG. 23, 252 designates an air intake chamber into which air is introduced through inlet 221. Air intake chamber 252 is connected with machine chamber 232. Microwave oven 200 includes another fan (fan 234 described afterwards) in addition to hood fan 208 to allow air flow in a manner different from that shown in FIGS. 22 and 23. This different air flow of microwave oven 200 will be described with reference to FIG. 24.

Figure 24:
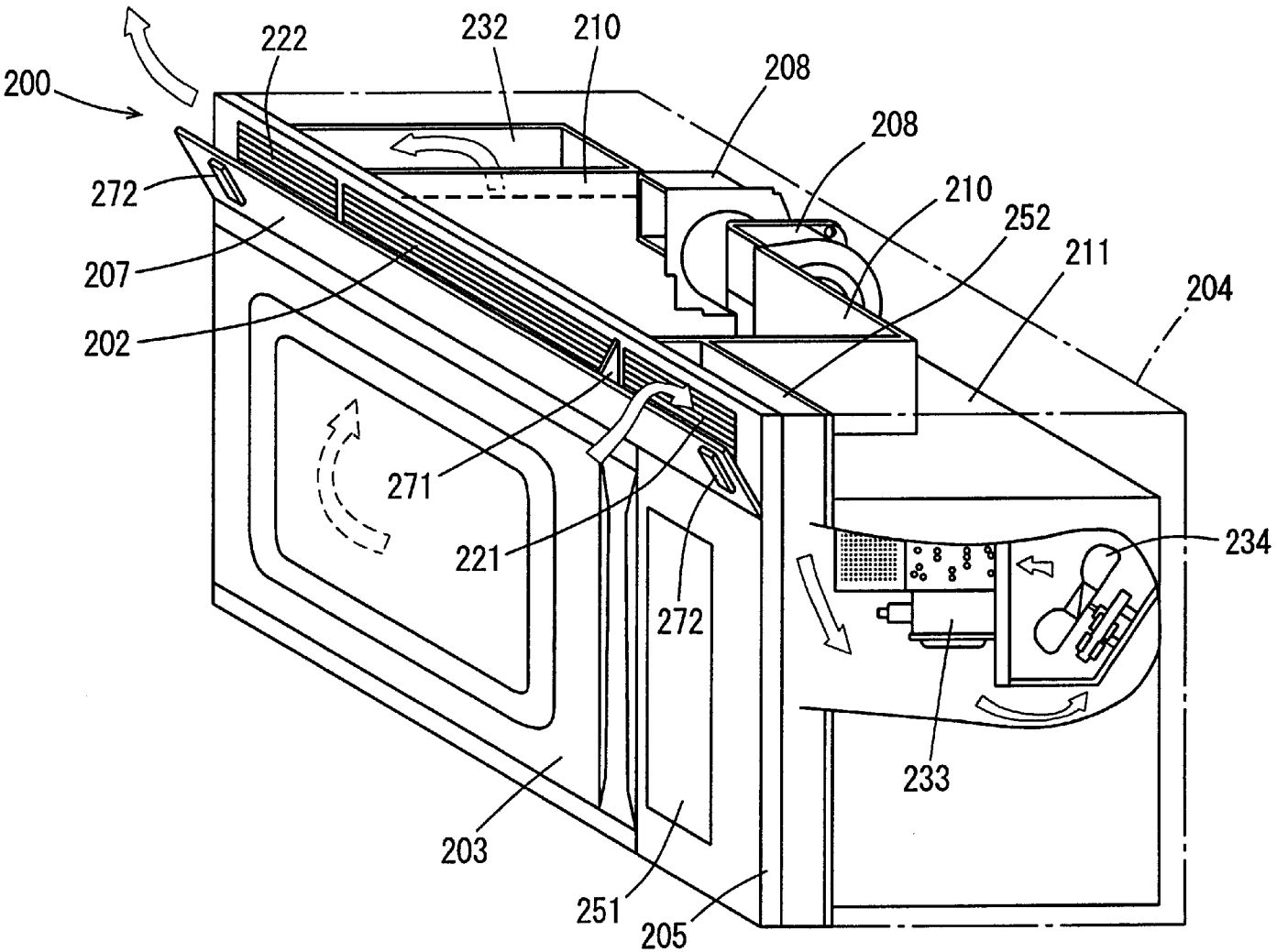
Figure 25:
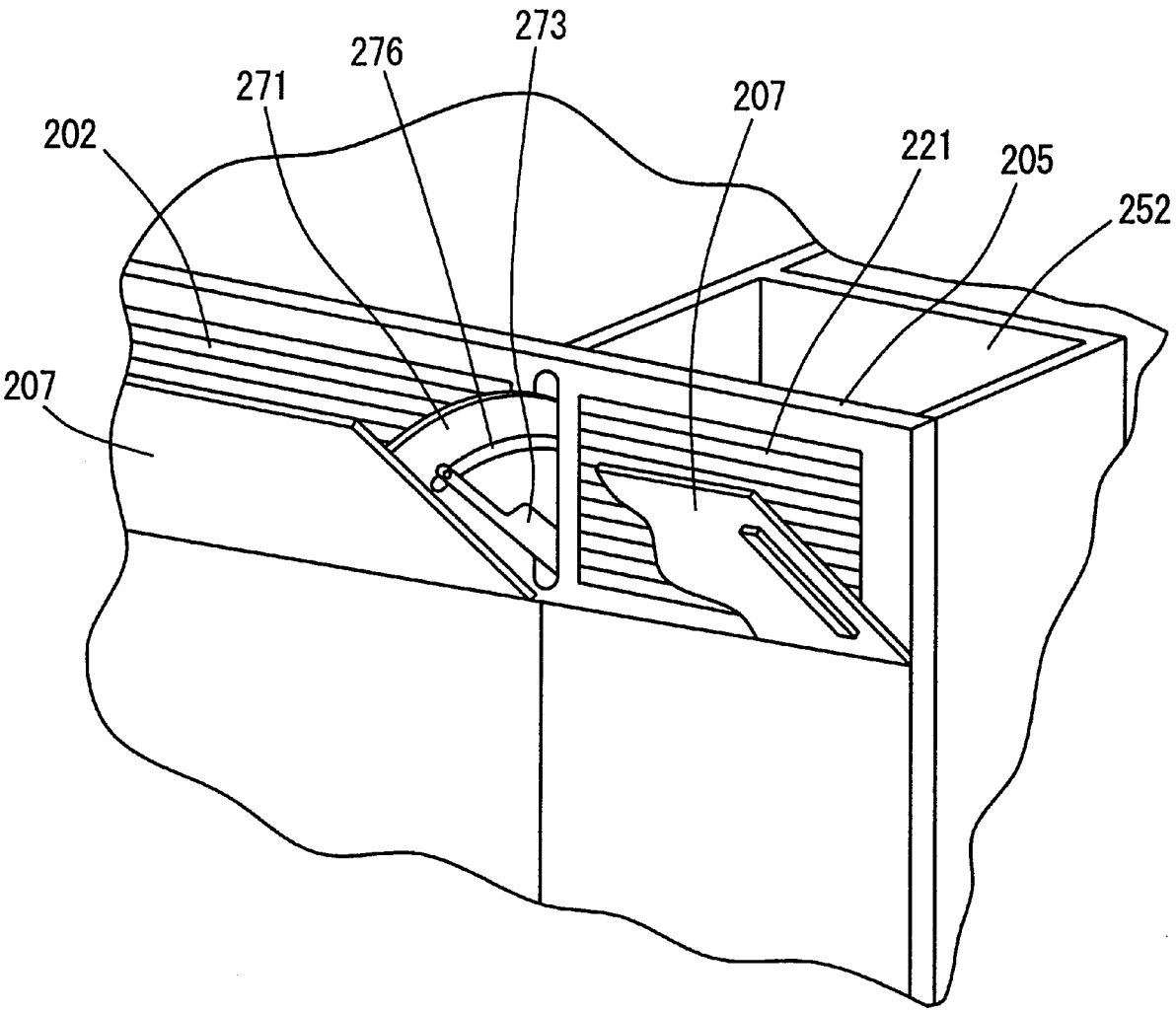
FIG. 25 is an enlargement view of the right upper portion of the microwave oven of the third embodiment.
Figure 26:
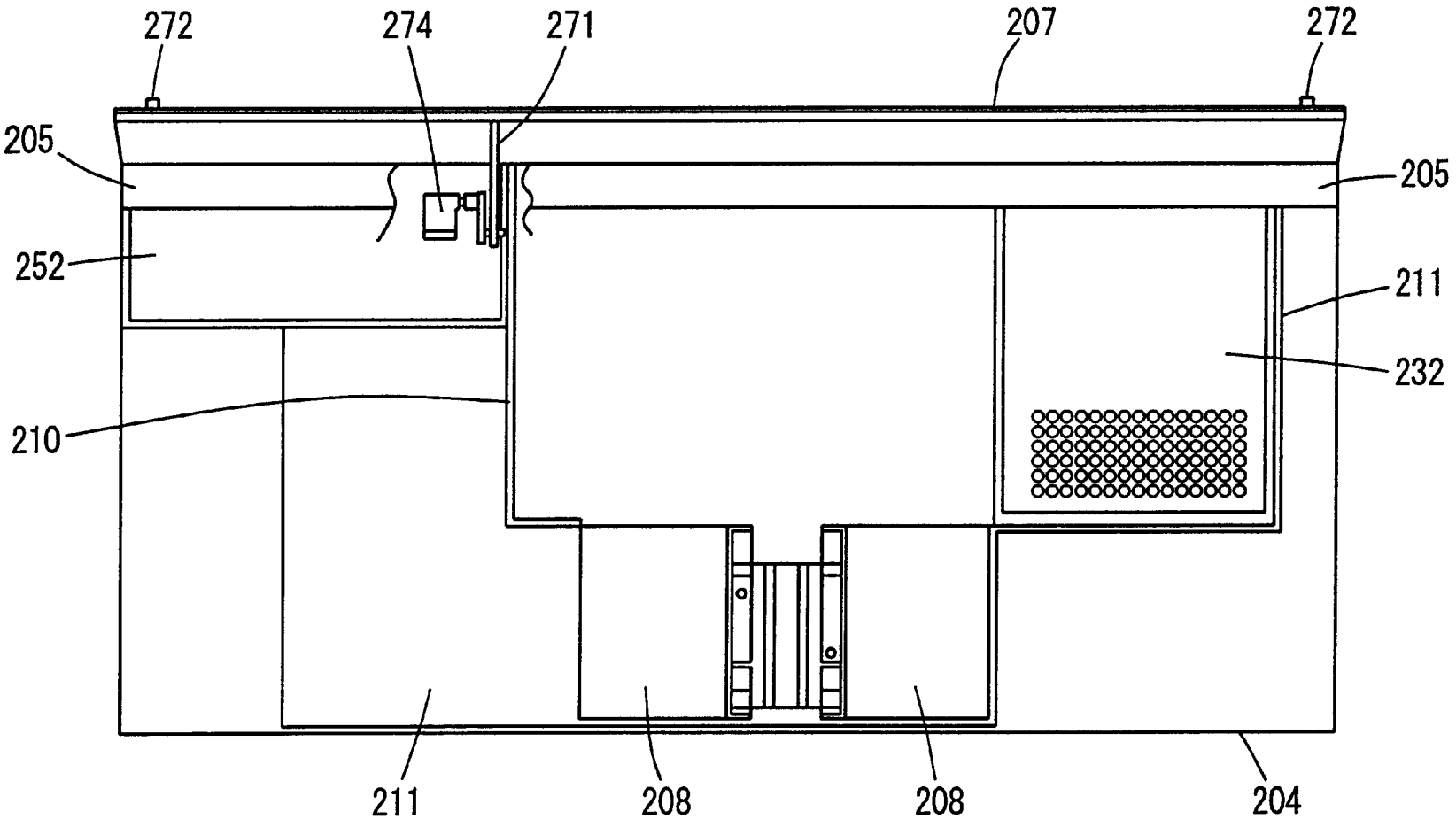
FIG. 26 is a plan view of the microwave oven of the third embodiment with the outer portion of the main body omitted.

FIG. 24 is a perspective view of microwave oven 200, likewise FIG. 23 with the outer contour of main body 204 omitted. The different air flow is represented by the open arrow in FIG. 24. FIG. 24 shows intermediate frame 211 partially broken away to facilitate description of the interior of machine chamber 231.

Microwave oven 200 includes magnetron 233 to heat an object in heat chamber 230 and a fan 234 to cool the components such as magnetron 233 in machine chamber 231. Upon actuation of fan 234 in microwave oven 200, cover 207 attains an open state shown in FIG. 23 from the closed state shown in FIG. 20. Air is admitted into heat chamber 230 from inlet 221 via air intake chamber 252 and machine chamber 231, as indicated by the open arrow in FIG. 24. The air passes through exhaust chamber 232 to be discharged outside microwave oven 200 through outlet 222.

Air flows in a different manner by hood fan 208 and fan 234 in microwave oven 200. Microwave oven 200 has cover 207 automatically attaining an open state as shown in FIG. 23 or 24 when either hood fan 208 or fan 234 functions, as will be described afterwards. When the drive of hood fan 208 and fan 234 stops, cover 207 attains the closed state shown in FIG. 20. In microwave oven 200, fan 234 functions automatically when a heating operation is effected by magnetron 233. Hood fan 208 can be actuated by operating a predetermined key on control panel 251. In other words, hood fan 208 and fan 234 function independently in microwave oven 200.

The structure of cover 207 will be described with reference to FIGS. 25–28.

An arc-like window 276 is formed in partition panel 271. Microwave oven 200 includes an arm 273 in the proximity of partition wall 271, and also a stepping motor 274 at the upper portion of the wall forming air intake chamber 252 and at a position corresponding to the back side of inlet 221. Aim 273 has one end connected to stepping motor 274 and the other end connected to partition wall 271 via a connection member 275 and window 276.

Stepping motor 274 is arranged at a position corresponding to the back side of inlet 221 in order to suppress temperature rise of stepping motor 274. It is to be noted that inlet 221 is the region where air is introduced in microwave oven 200. This means that this area is lower in temperature than the other area of microwave oven 200 that encounters temperature rise by the heating operation. By providing stepping motor 274 at a position corresponding to the back side of inlet 221 rather than the position corresponding to the back side of outlet 202 or 222, increase in temperature of stepping motor 274 can be suppressed.

Figure 27:
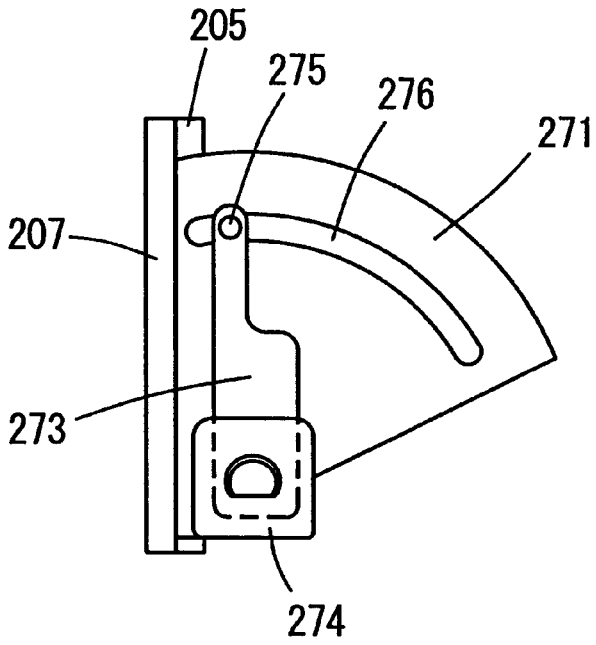
FIG. 27 is an enlargement view of the microwave oven of the third embodiment in the proximity of the partition panel.
Figure 28:
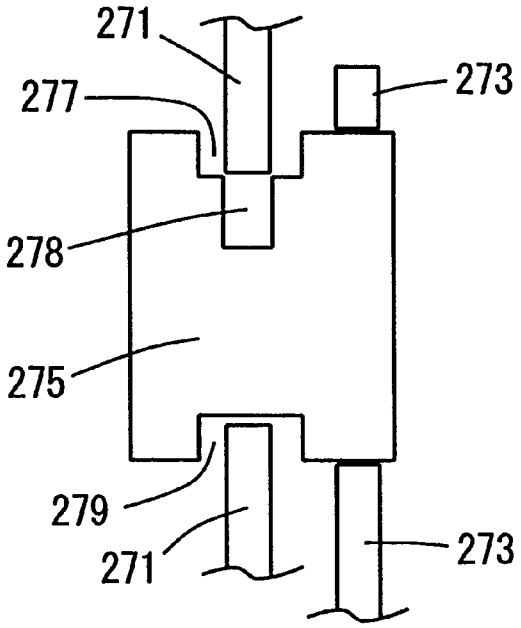
FIG. 28 is an enlargement view of the microwave oven of the third embodiment in the proximity of the connection member.

When hood fan 208 or fan 234 is actuated in microwave oven 200, arm 273 rotates counterclockwise in FIG. 27 about the connecting portion with stepping motor 274 by the drive of stepping motor 274. As a result, cover 207 attains an open state. FIG. 28 is an enlarged view of the neighborhood of connection member 275 of microwave oven 200 to describe the mechanism of the status change of cover 207, viewed from the front side.

Connection member 275 is attached to arm 273. Connection member 275 includes a first groove 277 and a second groove 278 at the upper end, and also a lower groove 279 at the lower end. First groove 277 and lower groove 279 have a greater width with respect to the thickness of partition wall 271. Second groove has a width substantially equal to the thickness of partition wall 271. When hood fan 208 and fan 234 are not actuated, connection member 275 sandwiches partition panel 271 with first groove 277 and lower groove 279. Second groove 278 does not sandwich partition panel 271 here.

When hood fan 208 or fan 234 is actuated and stepping motor 274 is driven, arm 273 moves upwards, whereby connection member 275 also moves upwards. In response, partition panel 271 is fitted in second groove 278. Partition panel 271 is displaced according to the operation of arm 273. In response to a further drive of stepping motor 274, arm 273 rotates counterclockwise in FIG. 27 about the connecting portion with stepping motor 274. Accordingly, partition panel 271 rotates counterclockwise about the portion overlapping with stepping motor 274. As a result, cover 207 attains an open state. When cover 207 returns to the closed state, partition panel 271 is fitted in second groove 278, and arm 273 is rotated by stepping motor 274 clockwise in FIG. 27 about the connection portion with stepping motor 274.

When hood fan 208 and fan 234 are not actuated, partition panel 271 is not fitted in second groove 278. Therefore, partition panel 271 can be rotated clockwise or counterclockwise in FIG. 27 without having to rotate arm 273. Accordingly, cover 207 can be switched between the open/close state manually. In switching cover 207 to the open/close state manually, partition panel 271 is displaced corresponding to first groove 277 and lower groove 279 of the resting connection member 275 in window 276.

Thus, cover 207 can be switched to an open/close state automatically according to the operational status of hood fan 208 and fan 234. The switching of the open/closed state of cover 7 will be described hereinafter.

Figure 29:
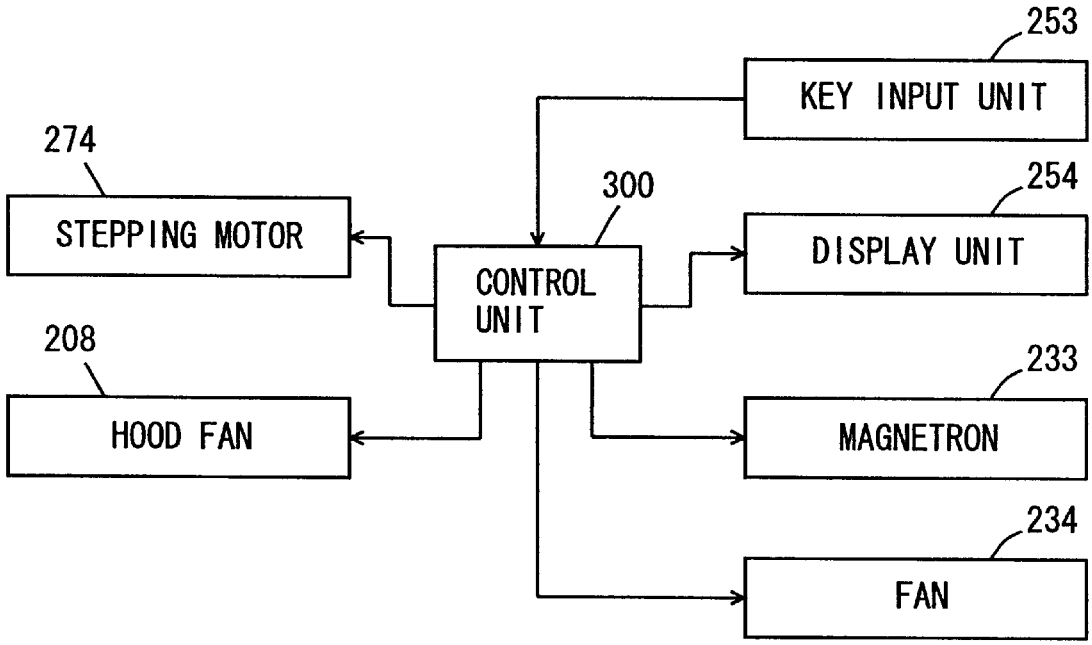
FIG. 29 is a control block diagram of the microwave oven of the third embodiment.

FIG. 29 is a control block diagram of microwave oven 200. Microwave oven 200 includes a control unit 300 with a microcomputer to provide overall control of the operation of microwave oven 200.

Figure 30:
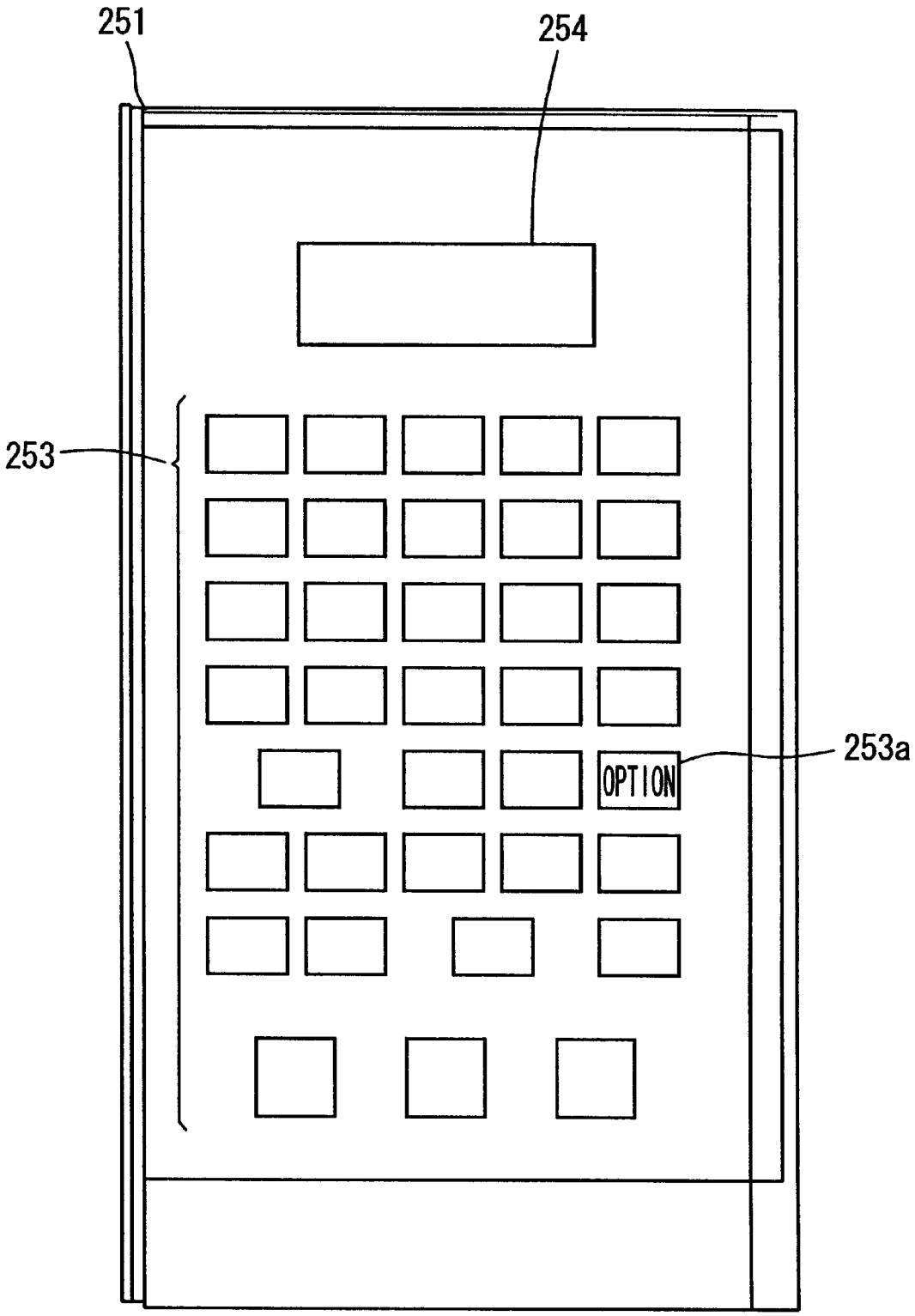
FIG. 30 shows a control panel of the microwave oven of the third embodiment.

Control unit 300 is connected to a key input unit 253, a display unit 254, magnetron 233, fan 234, stepping motor 274 and hood fan 208. The user inputs information through key input unit 253. Key input unit 253 is formed of various keys on control panel 251 as shown in FIG. 30. Display unit 254 is formed of, for example, liquid crystal, and provided on control panel 251 as shown in FIG. 30. The operational status of microwave oven 200 and input menus and the like are displayed on display unit 254. Control unit 300 provides control of display unit 254, magnetron 233, fan 234, stepping motor 274, and hood fan 208 according to the information input through key input unit 253.

The control of switching the open/close state of cover 207 by control unit 300 will be described in detail hereinafter.

In microwave oven 200, the air flow direction of hood fan 208 can be altered by modifying the attached direction of hood fan 208. The switching of the open/close state of cover 207 differs according to the air flow direction of hood fan 208. Therefore, altering the air flow direction of hood fan 208 will be described prior to describing the control.

Figure 31:
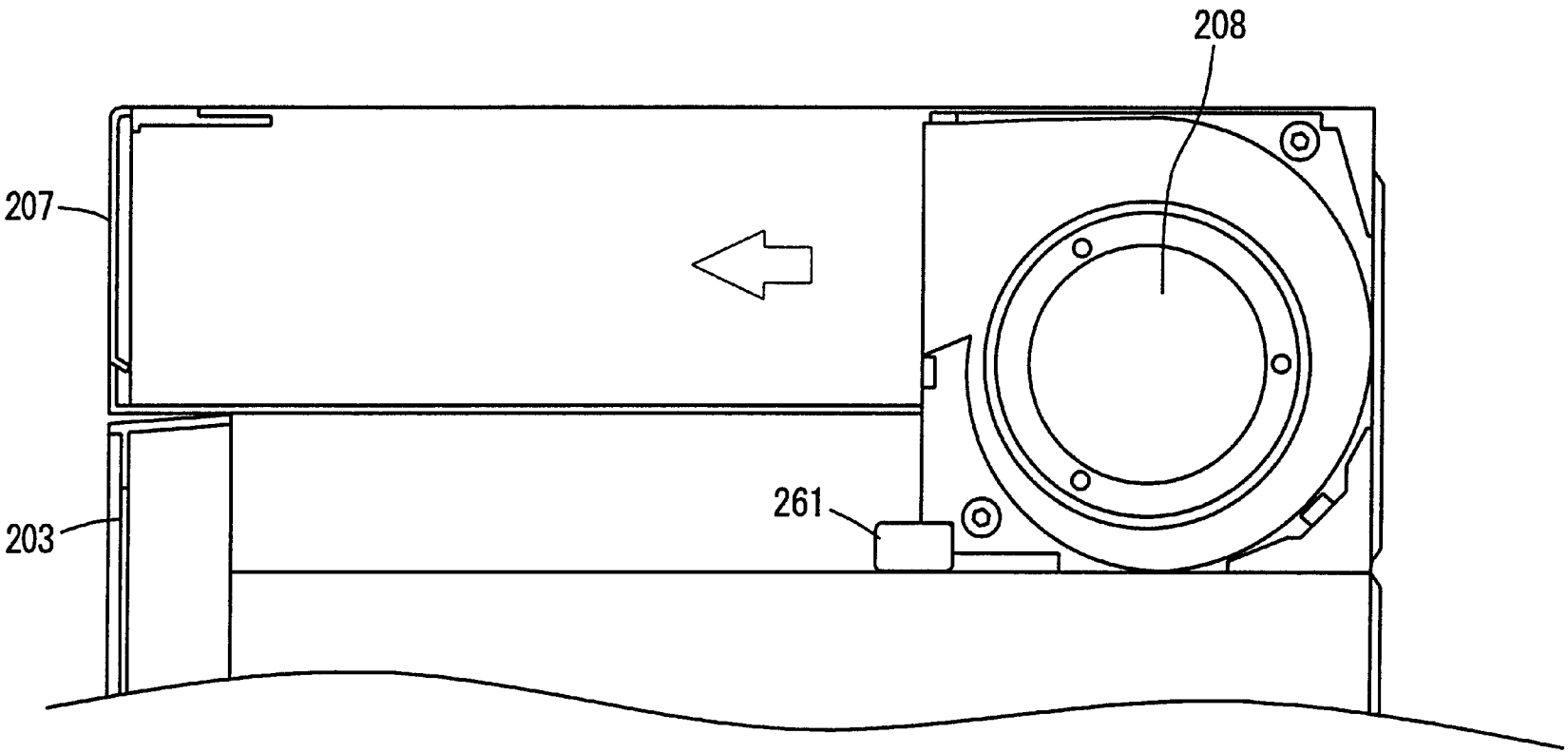
FIGS. 31, 32, and 33 are diagrams to describe the air flow direction of the hood fan in the microwave oven of the third embodiment.
Figure 32:
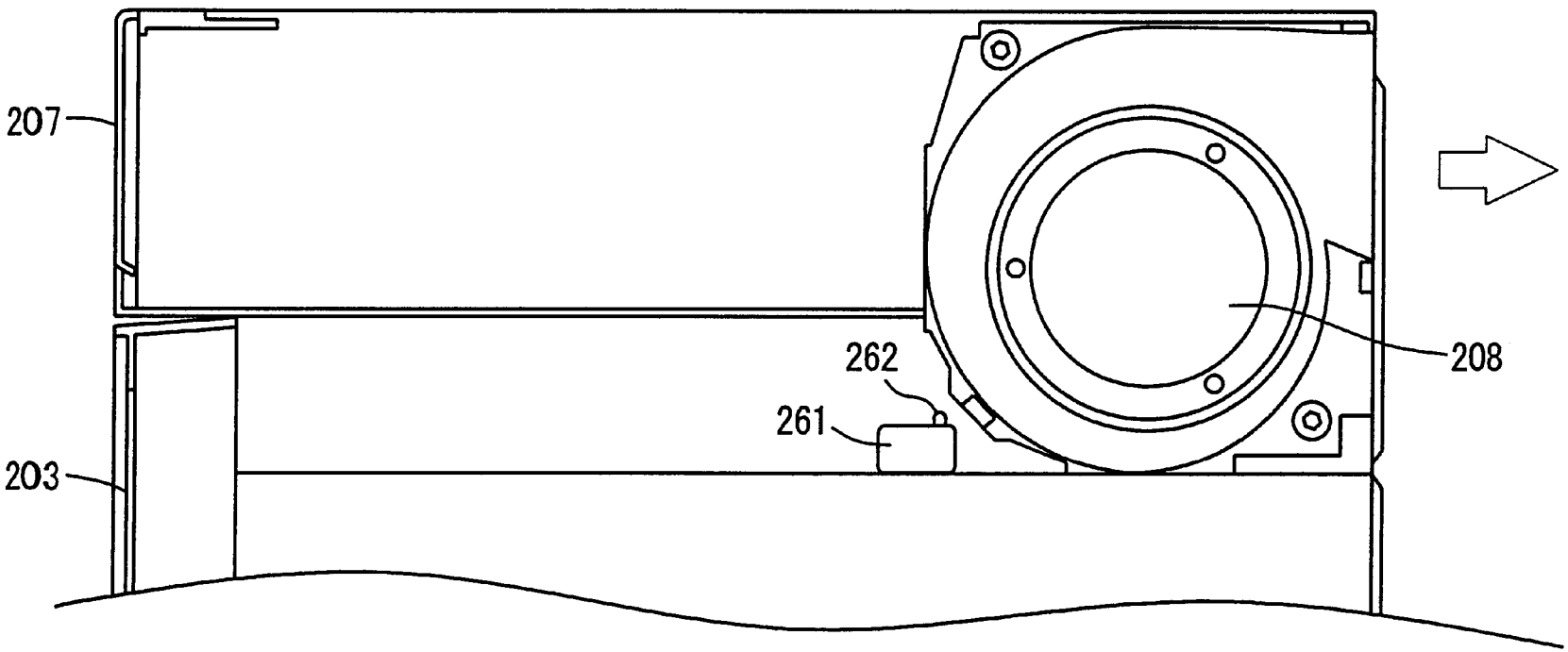
Figure 33:
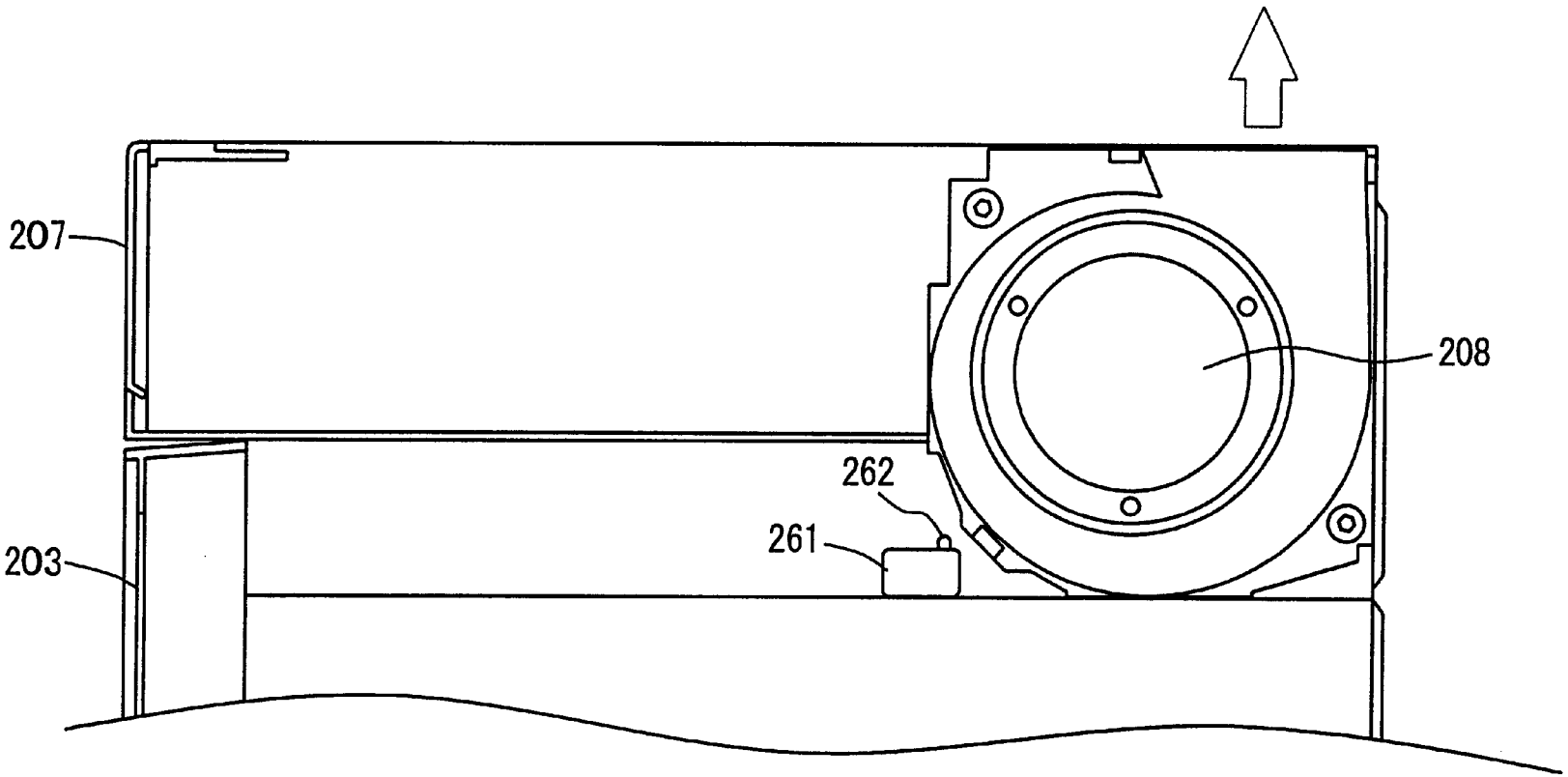

Referring to FIGS. 31–33, the positional relationship between the air flow direction of hood fan 208 (open arrow in each drawing) and cover 207 is schematically shown. FIG. 31 corresponds to the case where the air flow of hood fan 208 is directed front of microwave oven 200, as in the previous description. FIG. 32 corresponds to the case where the air flow is directed backwards of microwave oven 200. FIG. 33 corresponds to the case where the air flow is directed upwards of microwave oven 200.

Microwave oven 200 is implemented to have the air flow direction of hood fan 208 set to any of the three types shown in FIGS. 31–33. Although not shown, an opening to discharge air outside main body 204 is provided at the area corresponding to the port of hood fan 208 at the upper face and back face of main body 204.

When the air flow of hood fan 208 is directed frontwards of microwave oven 200 as shown in FIG. 31, cover 207 must be opened/closed cooperable with the air flow direction of hood fan 208. In contrast, the open/closure of cover 207 does not have to be cooperated with the air flow operation of hood fan 208 when the air flow of hood fan 208 is directed in a direction other than the front direction of microwave oven 200, as in FIGS. 32 and 33. For this purpose, microwave oven 200 includes a fan switch 261 that can sense whether the air flow of hood fan 208 is directed frontwards or in another direction. Detection of whether the air flow direction is frontwards or in another direction is set forth in the following. A switch button 262 is provided at fan switch 261. Switch button 262 is provided so as to be depressed when hood fan 208 is arranged so that the air flow is directed frontwards, and so as to be not depressed when hood fan 208 is arranged so that the air flow is directed to another direction. Accordingly, the air flow direction can be detected.

Figure 34:
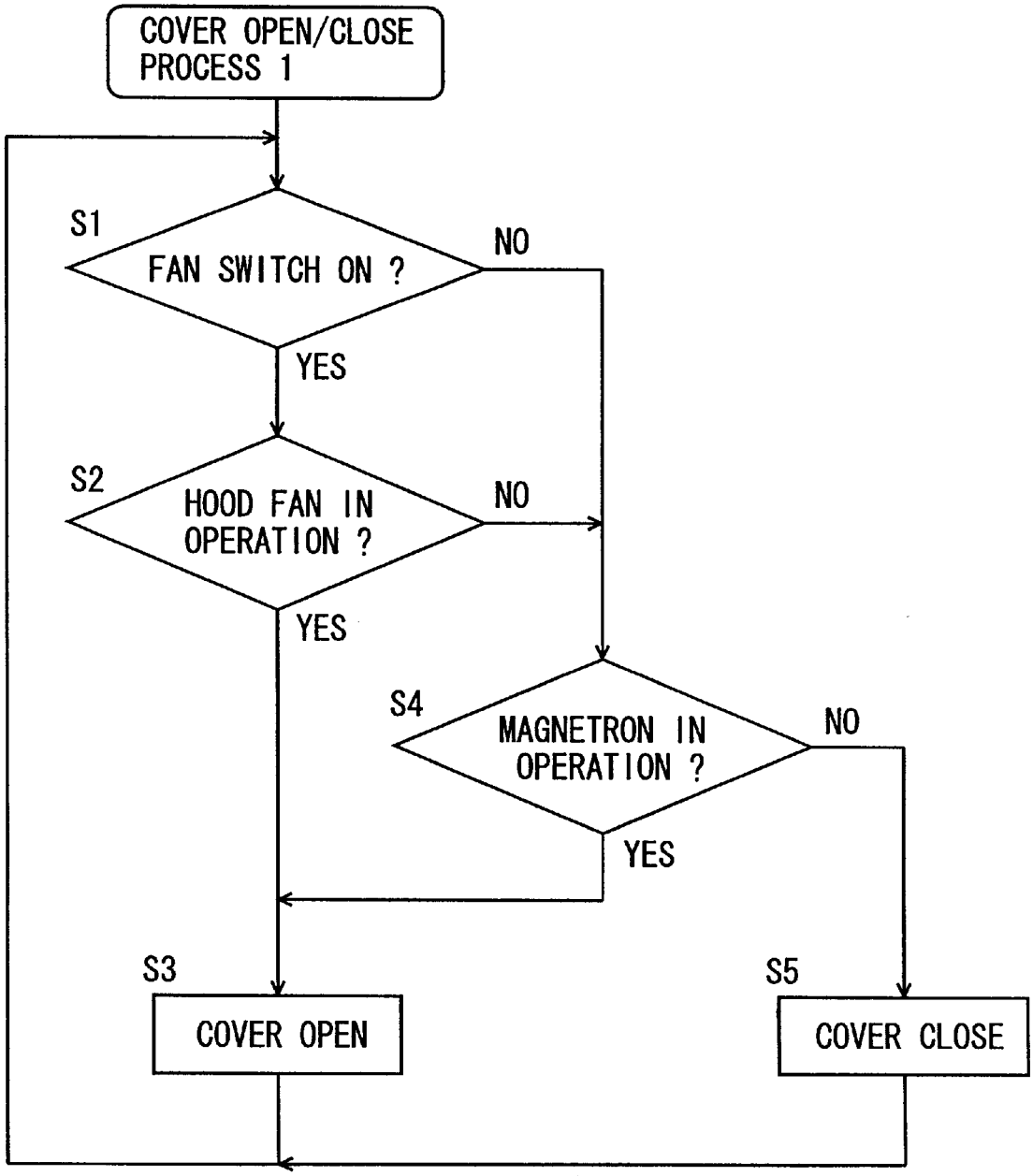
FIG. 34 is a flow chart of the cover open/close process of the microwave oven of the third embodiment.

The contents of the cover open/close process of switching the state of cover 207 by control unit 300 will be described with reference to the flow chart of FIG. 34.

At S1, determination is made whether fan switch 261 is ON or not, i.e. whether hood fan 208 is arranged as shown in FIG. 31 with switch button 262 depressed. When determination is made that fan switch 261 is ON (Yes at S1), control proceeds to S2 to determine whether hood fan 208 is actuating or not.

When determination is made that hood fan 208 is during actuation (Yes at S2), control proceeds to S3, whereby cover 207 attains an open state. Then, control returns to S1.

When determination is made that hood fan 208 is not functioning (No at S2), control proceeds to S4 to determine whether magnetron 233 is operating or not, i.e. whether fan 234 is functioning or not. When determination is made that magnetron 233 is functioning (Yes at S4), control proceeds to S3, whereby cover 207 is set to an open state. When determination is made that magnetron 233 is not functioning (No at S4), control proceeds to S5, whereby cover 207 is set to a closed state. Then, control returns to S1. When determination is made that fan switch 261 is not ON at S1 (No at S1), control proceeds directly to S4.

According to the above process, cover 207 is opened and closed when hood fan 208 or fan 234 is functioning and not functioning, respectively, when hood fan 208 is arranged as shown in FIG. 31. When hood fan 208 is arranged as shown in FIG. 32 or 33, cover 207 is opened and closed if fan 234 is functioning and not functioning, respectively.

In the above embodiment, control unit 300 provides control of the open/close state of cover 207 according to the operational status of hood fan 208 and fan 234 in the process of S2–S5. By virtue of the execution of the process of S2–S5 in microwave oven 200, the cover can be opened/closed appropriately irrespective of whether hood fan 8 is functioning according to the heating operation by a heating unit such as magnetron 233 or whether fan 234 is operated independent of the heating operation of the heat unit.

In the present embodiment, cover 207 attains a closed state at S5 when determination is made that magnetron 33 is not functioning at S4. This means that cover 7 attains a closed state when the operation of magnetron 33 stops. However, the present embodiment is not limited thereto. Cover 7 may be set to a closed state at an elapse of a predetermined time from the termination of the heating operation.

A modification of the present embodiment will be described hereinafter. In the present modification, control unit 300 is made to detect whether the air flow of hood fan 208 is directed frontward or not through the manual operation of a workman or a user through key input unit 253, absent of fan switch 261. As an example of input through key input unit 253, a predetermined key (for example, option key 253*a*) is depressed, whereby a predetermined menu for designating the air flow direction of hood fan 208 is displayed on display unit 253. A predetermined key can be manipulated therefrom.

Figure 35:
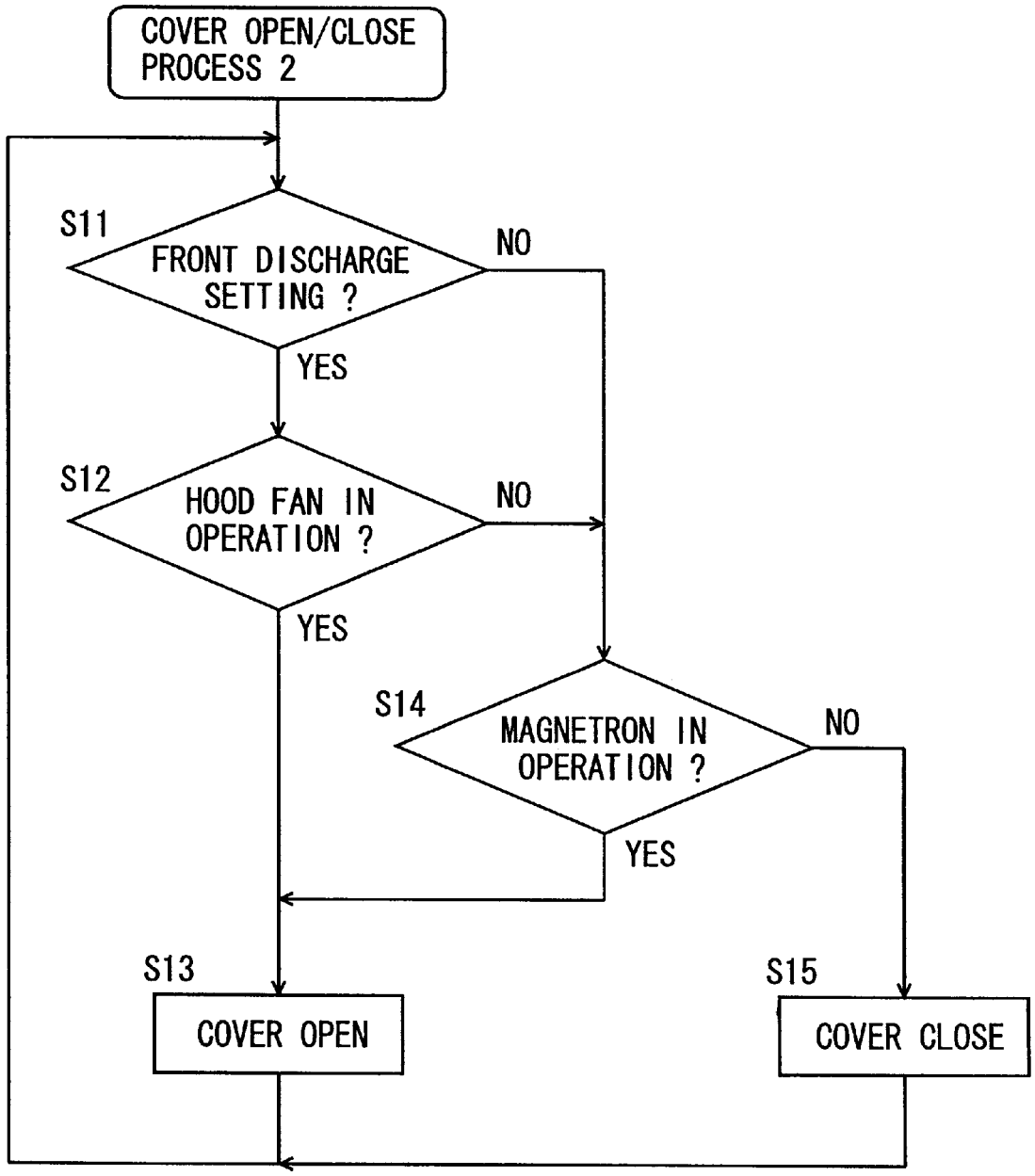
FIG. 35 is a flow chart of a modification of the cover open/close process.
Figure 36A:
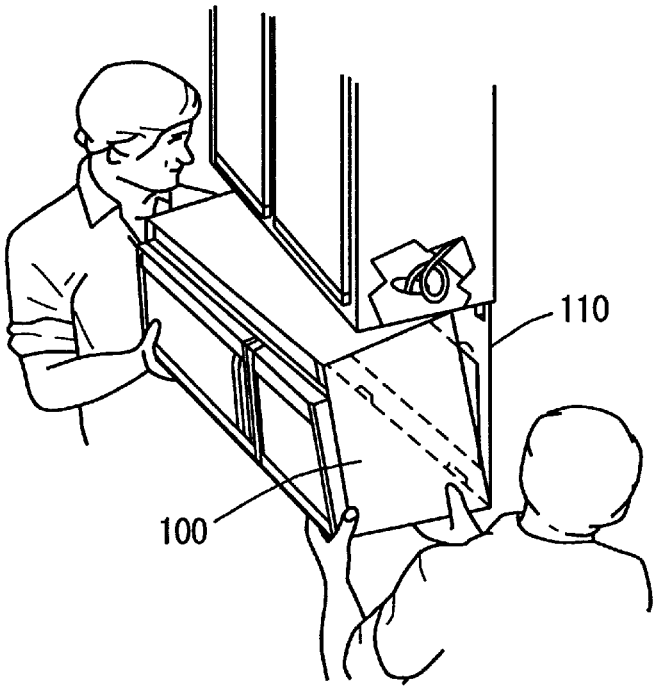
FIG. 36A PRIOR ART
FIGS. 36A and 36B are diagrams to describe the installment of a conventional high-placement type cooking appliance to a wall.
Figure 36B:
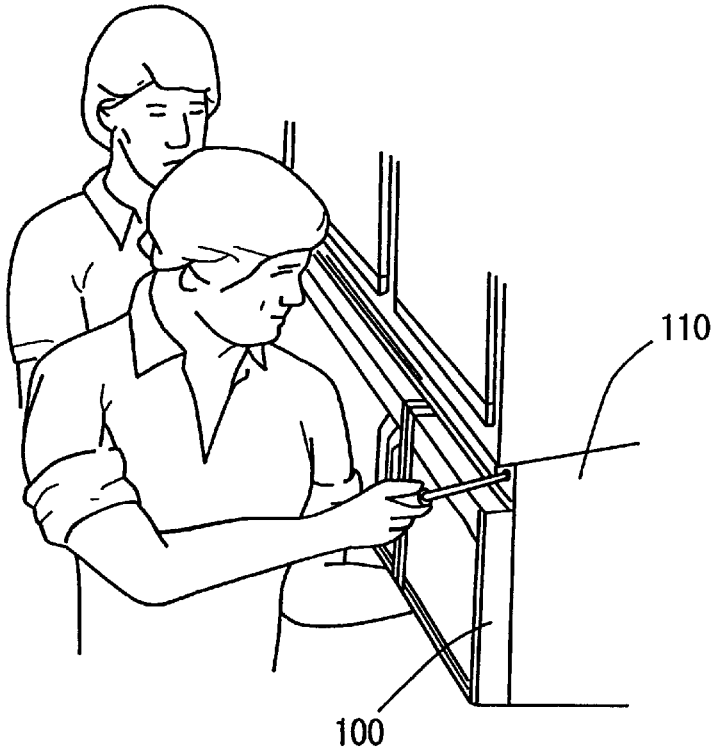
FIG. 36B PRIOR ART

The contents of the cover open/close process of switching the status of cover 207 by control unit 300 in the present modification will be described hereinafter with reference to the flow chart of FIG. 35.

At S11, determination is made whether the air flow direction of hood fan 208 is input (Set) to the forward direction (front exhaust) through key input unit 253. When determination is made of the setting of front discharge (Yes at S11), control proceeds to S12 to determine whether hood fan 208 is functioning or not.

When determination is made that hood fan 208 is in operation (Yes at S12), control proceeds to S13, whereby cover 207 is set to an open state. Then, control returns to S11. When determination is made that hood fan 208 is not in operation (No at S12), control proceeds to S14 to determine whether magnetron 233 is in operation or not. When determination is made that magnetron 233 is in operation (Yes at S14), control proceeds to S13, whereby cover 207 is set to an open state. When determination is made that magnetron 233 is not in operation (No at S14), control proceeds to S15, whereby cover 207 is set to a closed state. Then, control returns to S11. If determination is made that front discharge is not set at S11 (No at S11), control proceeds directly to S14.

In the present modification, fan switch 261 is dispensable by providing the function of designating the air flow direction of hood fan 208 by means of key input unit 253.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking appliance including a heat unit heating foodstuff, a controller controlling an operation of said heat unit, and a casing enclosing said heat unit and said controller, and attached to a fixture panel secured to a sidewall, said fixture panel having a pair of attachment members provided spaced apart from each other, and a hook provided below said pair of attachment members, said casing having at a back side an elongated aperture for engaging with said pair of attachment members, and a bottom panel engaging with said hook, each of said attachment members including an upper edge portion and a lower edge portion continuous to said upper edge portion, said upper edge portion having an inclination portion extending upwards and a horizontal portion continuous to said inclination portion, said upper edge portion guiding said casing upwards via said elongated aperture when said casing is to be attached to said fixture panel.

2. The cooking appliance according to claim 1, wherein said attachment member has a convex portion provided between said inclination portion and said horizontal portion.

3. The cooking appliance according to claim 1, wherein said casing includes a bottom panel located at a bottom portion of said casing, and a body frame covering an upper portion of said bottom panel, said controller is provided on said bottom panel, and said bottom panel is detachable from said body frame with said cooking appliance attached to said fixture panel.

4. A method of installing a cooking appliance having a heat unit heating foodstuff, a controller controlling an operation of said heat unit, and a casing enclosing said heat unit and said controller attached to a fixture panel secured to a sidewall, said method comprising the steps of:

passing a pair of attachment members provided at said fixture panel through an elongated aperture provided at a back side of said casing, moving said casing obliquely upwards along an inclination portion formed at said attachment member, engaging an upper edge of said elongated aperture with a convex portion formed between the inclination portion and a horizontal portion of said attachment member at a termination of said oblique upward movement of said casing, and supporting a bottom panel of said casing on a hook provided at a lower edge portion of said fixture panel, and setting the back side of said casing along said fixture panel by rotating said casing about said hook.

5. The method of installing a cooking appliance according to claim 4, comprising the step of moving said casing on a predetermined base having a slope upwards obliquely along an inclination portion formed at said attachment member.

6. The method of installing a cooking appliance according to claim 4, wherein the cooking appliance includes a fastening member engaging with a fixture panel secured to a sidewall, including the steps of:

setting said cooking appliance at a first state in which said cooking appliance is tilted forward on a predetermined base in front of said sidewall, setting said cooking appliance from said first state to a second state in which said cooking appliance is tilted forward and has said fastening member engaging with said fixture panel, setting said cooking appliance at a third state in which said forward tilt is less than in said second state by rotating the cooking appliance about said fastening member from said second state, and securing said cooking appliance attaining said third state to said fixture panel, wherein a predetermined member is used to support said cooking appliance attaining said third state in said step of securing said cooking appliance attaining said third state to said fixture panel.

7. The method of installing a cooking appliance according to claim 6, wherein said predetermined member comprises a support base to support said cooking appliance attaining said third state.

8. The method of installing a cooking appliance according to claim 6, wherein said predetermined member comprises a sub fastening member provided at said cooking appliance, and engaging with said fixture panel when said cooking appliance is at said third state.

9. The method of installing a cooking appliance according to claim 4, wherein said cooking appliance is packed in a predetermined cardboard box for transportation, and said predetermined member is formed using said cardboard box.

10. The method of installing a cooking appliance according to claim 6, wherein said step of setting said cooking appliance at said second state includes the step of sliding said cooking appliance on said predetermined base with a predetermined plate sandwiched between said predetermined base and said cooking appliance.

11. The method of installing a cooking appliance according to claim 4, wherein the cooking appliance includes a fastening member engaging with a fixture panel to a sidewall, including the steps of:

setting said cooking appliance at a first state in which said cooking appliance is tilted forward on a predetermined base in front of said sidewall, setting said cooking appliance from said first state to a second state in which said cooking appliance is tilted forward and has said fastening member engaging with said fixture panel, setting said cooking appliance at a third state in which said forward tilt is less than in said second state by rotating said cooking appliance about said fastening member from said second state, and securing said cooking appliance attaining said third state to said fixture panel, wherein a support member supporting said cooking appliance attaining the first state is used in said step of setting said cooking appliance at the first state.

* * * * *